US010711203B2

(12) United States Patent
Barrai et al.

(10) Patent No.: US 10,711,203 B2
(45) Date of Patent: Jul. 14, 2020

(54) HYDROCARBON PYROLYSIS

(71) Applicant: ExxonMobil Chemical Patents Inc., Baytown, TX (US)

(72) Inventors: Federico Barrai, Houston, TX (US); Elizabeth G. Mahoney, Houston, TX (US); John S. Coleman, Houston, TX (US); Dhaval A. Bhandari, Bridgewater, NJ (US); Brian M. Weiss, Bridgewater, NJ (US); Changmin Chun, Raritan, NJ (US); Frank Hershkowitz, Basking Ridge, NJ (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 2 days.

(21) Appl. No.: 16/320,136

(22) PCT Filed: Aug. 15, 2017

(86) PCT No.: PCT/US2017/046951

§ 371 (c)(1),
(2) Date: Jan. 24, 2019

(87) PCT Pub. No.: WO2018/044555

PCT Pub. Date: Mar. 8, 2018

(65) Prior Publication Data

US 2020/0024524 A1 Jan. 23, 2020

Related U.S. Application Data

(60) Provisional application No. 62/402,009, filed on Sep. 30, 2016, provisional application No. 62/381,722, filed on Aug. 31, 2016.

(30) Foreign Application Priority Data

Dec. 6, 2016 (EP) ..... 16202384

(51) Int. Cl.
*C10G 9/26* (2006.01)
*C10G 9/20* (2006.01)

(52) U.S. Cl.
CPC ..... *C10G 9/26* (2013.01); *C10G 9/203* (2013.01); *C10G 9/206* (2013.01)

(58) Field of Classification Search
CPC ..... C07C 11/24; C07C 5/327; C07C 5/32; C07C 11/04; C07C 2/78; C07C 4/04;
(Continued)

(56) References Cited

U.S. PATENT DOCUMENTS 5,494,881 A 2/1996 Machida et al.
7,815,873 B2 * 10/2010 Sankaranarayanan .... B01F 3/02 208/133

(Continued)

FOREIGN PATENT DOCUMENTS

WO 2013/043287 A 3/2013

*Primary Examiner* — Sharon Pregler

(57) ABSTRACT

The invention relates to hydrocarbon pyrolysis, to equipment and materials useful for hydrocarbon pyrolysis, to processes for carrying out hydrocarbon pyrolysis, and to the use of hydrocarbon pyrolysis for, e.g., hydrocarbon gas upgrading. The pyrolysis is carried out in a reactor which includes at least one thermal mass having an open frontal area ≤55%.

25 Claims, 7 Drawing Sheets

(58) Field of Classification Search
CPC .... C07C 1/24; C07C 2/76; C07C 4/02; C07C 5/367; B01J 19/2485; B01J 19/26; B01J 8/0278; B01J 8/0442; B01J 8/0492; B01J 19/24; B01J 4/002; B01J 8/02; C10G 9/26; C10G 9/203; C10G 9/206
See application file for complete search history.

(56) References Cited

U.S. PATENT DOCUMENTS

| | | | |
|---|---|---|---|
| 2007/0191664 | A1 | 8/2007 | Hershkowitz et al. |
| 2016/0176781 | A1 | 6/2016 | Hershkowitz et al. |

* cited by examiner

HYDROCARBON PYROLYSIS

PRIORITY CLAIM

This application is a National Stage Application of International Application No. PCT/US2017/046951 filed Aug. 15, 2017, which claims the benefit of Provisional Application No. 62/402,009, filed Sep. 30, 2016, European Patent Application No. 16202384.0, filed Dec. 6, 2016, and U.S. Patent Application Ser. No. 62/381,722, filed Aug. 31, 2016, which are incorporated herein by reference. Cross reference is made to the following related patent applications: U.S. Patent Application Ser. No. 62/466,050, filed Mar. 2, 2017, U.S. Patent Application Ser. No. 62/486,545, filed Apr. 18, 2017, PCT Patent Application No. PCT/US2017/046871, filed Aug. 15, 2017, and PCT Patent Application No. PCT/US2017/046879, filed Aug. 15, 2017, which are incorporated by reference herein.

FIELD

The invention relates to hydrocarbon pyrolysis, to equipment and materials useful for hydrocarbon pyrolysis, to processes for carrying out hydrocarbon pyrolysis, and to the use of hydrocarbon pyrolysis for, e.g., natural gas upgrading. The pyrolysis is carried out in a reactor which includes at least one thermal mass having an open frontal area ≤55%.

BACKGROUND

Olefinic compounds are a class of hydrocarbon compounds which have at least one double bond of four shared electrons between two carbon atoms. In part as a result of their utility as feeds for producing desirable products, olefin demand to grow, particularly for light olefin such as ethylene, propylene, and butenes.

Light olefin is produced in commercial quantities by steam cracking of hydrocarbon-containing feeds. A steam cracker generally includes a plurality of tubular members (typically referred to as "furnace tubes") located proximate to one or more fired heaters which heat the outer surface of the furnace tubes. A mixture of the feed and steam is introduced into the heated furnace tubes, and heat transferred from the furnace tube to the mixture results in the conversion of at least a portion of the feed to light olefin by pyrolysis. Conditions in the steam cracker are controlled, typically at a temperature in the range of 750° C. to 900° C., to achieve a fixed, predetermined feed conversion, typically in the range of about 60% to about 80%. Although ethylene is the primary light olefin product of steam cracking, the process can also produce appreciable yields of propylene and butenes, particularly when the steam cracker's feed comprises $C_{5+}$ hydrocarbon. Since steam cracking process conditions are selected to provide a fixed, predetermined feed conversion, ethylene, propylene and butylene yields are substantially constant. Besides light olefin, steam cracking also produces appreciable yields of molecular hydrogen, methane, ethane, propane, butanes, acetylene, butadiene, and $C_{5+}$ saturated and unsaturated hydrocarbon, including coke. Steam crackers typically include facilities for recovering light olefin from the steam cracker's effluent.

The amount of steam present in the feed-steam mixture is generally in the range of about 0.2 pounds of steam per pound of hydrocarbon feed (0.09 kg/kg) to 0.7 lbs. of steam per pound of hydrocarbon feed (0.32 kg/kg). Typically, steam pressure is in the range of about 30 lbs. per sq. in. (psig, 207 kPag) to about 80 psig (552 kPag). The presence of steam lessens the amount of coke produced during the pyrolysis by decreasing hydrocarbon partial pressure. Steam in the feed-steam mixture also reacts with coke and coke precursors during the pyrolysis, which further decreases the amount coke produced during the pyrolysis. Even with added steam, however, the pyrolysis produces an appreciable yield of coke and coke precursors, and a portion of the coke accumulates in the furnace tubes.

Accumulating coke leads to both an undesirable pressure-drop increase across the tubes' internal flow path and a decrease in heat transfer to the feed-steam mixture. To overcome these difficulties, at least a portion of accumulated coke is removed from the interior of a tube by switching the tube from pyrolysis mode to decoking mode. During decoking mode, the flow of feed-steam mixture into the tube is terminated, and a flow of decoking fluid is established instead. The decoking fluid, typically comprising air and/or steam, reacts with and removes the accumulated coke. When sufficient coke has been removed, the tube is switched from decoking mode to pyrolysis mode to resume light olefin production. Although periodic decoking mode operation is effective for lessening the amount of accumulated coke, this benefit is obtained at a substantial energy cost. In part to lessen damage to the furnace tubes, e.g., by repeated thermal expansion/contractions, the fired heaters operate not only during pyrolysis mode, but also during decoking mode, even though an appreciable amount of recoverable light olefin is not produced during decoking mode.

In order to increase energy efficiency and improve the yield of light unsaturated hydrocarbon, processes have been developed which carry out the pyrolysis in a regenerative pyrolysis reactor. Such reactors generally include a regenerative thermal mass, e.g., a channeled member comprising refractory. The thermal mass is preheated, and then a flow of the hydrocarbon-containing feed is established through the channel. Heat is transferred from the thermal mass to the hydrocarbon feed, which increases the hydrocarbon feed's temperature and results in conversion of at least a portion of the feed by pyrolysis. The pyrolysis produces a pyrolysis product comprising molecular hydrogen, methane, acetylene, ethylene, and $C_{3+}$ hydrocarbon, which includes coke and coke precursors. At least a portion of the coke remains in the passages of the thermal mass, and the remainder of the pyrolysis product is conducted away from the reactor as a pyrolysis effluent. Ethylene is typically recovered from the pyrolysis effluent downstream of the reactor. Since the pyrolysis is endothermic, pyrolysis mode operation will eventually cool the thermal mass, e.g., to a temperature at which the pyrolysis reactions terminate. The ability to carry out pyrolysis reactions is restored by regenerating the thermal mass during a heating mode. During heating mode, the flow of hydrocarbon-containing feed to the regenerative pyrolysis reactor is terminated. Flows of oxidant and fuel are established to the reactor, typically in a direction that is the reverse of the feed flow direction, and heat is transferred from combustion of the fuel and oxidant to the thermal mass to reheat the thermal mass. After the reactor is sufficiently reheated, the reactor is switched from heating mode to pyrolysis mode.

U.S. Patent Application Publication No. 2016-176781 discloses increasing ethylene yield from a regenerative pyrolysis reactor by operating the pyrolysis mode in an elongated tubular regenerative pyrolysis reactor at a temperature in the range of 850° C.-1200° C. and a hydrocarbon partial pressure ≥7 psia (48 kPa). The reference (e.g., in its FIG. 1A) discloses controlling the pyrolysis mode for increased ethylene selectivity and decreased selectivity for coke and methane by establishing a sharp thermal gradient in the bulk gas temperature profile between a region of substantially constant temperature at which the pyrolysis can occur and a substantially constant lower temperature at which pyrolysis does not occur. During pyrolysis, the position of the gradient within the tubular reactor moves inward as the reactor cools, i.e., toward the midpoint of the reactor's long axis. The cooled reactor is then switched to heating mode, during which the gradient moves outward, i.e., away from the midpoint of the reactor's long axis. Although utilizing such pyrolysis conditions results in a coke yield that is less than that of steam cracking, some coke does accumulate in the channel. Advantageously, the reference reports that accumulated coke can be oxidized to volatile products such as carbon dioxide during heating mode by combustion using a portion of the oxidant in the oxidant flow. Energy efficiency is increased over steam cracking because (i) heating is not needed during pyrolysis mode and (ii) heat released by coke combustion in passages of the thermal mass during heating mode aids thermal mass regeneration. Although the process is more energy efficient than steam cracking, maintaining a sharp temperature gradient in the bulk gas temperature profile leads to substantially constant ethylene and $C_{3+}$ hydrocarbon selectivities within the pyrolysis zone during pyrolysis mode. Moreover, since the sharp gradient moves downstream during the pyrolysis, the substantially constant ethylene and $C_{3+}$ selectivities are maintained along the length of the pyrolysis zone for the duration of pyrolysis mode.

Energy efficient processes are now desired which have flexibility to produce a range of product selectivities along the length of the pyrolysis zone during pyrolysis mode, particularly processes which exhibit appreciable feed conversion without excessive coke yield.

SUMMARY OF THE INVENTION

The invention is based in part on the discovery that regenerative pyrolysis reactors can be operated to produce a range of product slectivities, particularly light olefin selectivities, along the length of the pyrolysis zone during pyrolysis mode. This is achieved with appreciable feed conversion and without excessive coke yield. Contrary to the teachings of the prior art, it is beneficial to establish a bulk gas temperature profile during the pyrolysis that does not exhibit a sharp gradient between a substantially constant higher temperature region and a substantially constant lower temperature region. It also has been found to be beneficial for certain features of the bulk gas temperature profile to exhibit a temperature decrease of ≤100° C. during the course of the pyrolysis. Doing so provides yields of desirable products which do not vary appreciably during the pyrolysis, leading to a significant simplification of olefin recovery and purification systems located downstream of the pyrolysis reactor. For a wide range of pyrolysis conditions and commercially-significant feed rates, these desirable characteristics of the bulk gas temperature profile can be achieved when the reactor includes a thermal mass having an open frontal area ≤55%.

Accordingly, certain aspects of the invention relate to a hydrocarbon pyrolysis process carried out in at least one elongated flow-through reactor of length $L_R$. The reactor has an internal volume which includes at least two regions. The reactor also includes at least one heated thermal mass located in the first region, wherein the thermal mass has a length $L_M$ that is at least $0.1*L_R$. The thermal mass has at least one internal channel, first and second apertures in fluidic communication with the channel, and an OFA≤55%. The first and second apertures are separated by a flow-path of length $L_M$ through the channel. The first aperture is proximate to the first opening. A flow of the feed is established into the channel toward the second aperture at a flow rate ≥0.01 kg/s by introducing the feed through the first opening and through the first aperture via the first opening. The feed comprises ≥1 wt. % of $C_{2+}$ hydrocarbon. $C_{2+}$ hydrocarbon in the feed is pyrolysed in the channel under pyrolysis conditions during a pyrolysis time $t_P$ which starts at a first time $t_1$ and ends at a second time $t_2$. The pyrolysis produces a flow of a pyrolysis product comprising molecular hydrogen and $C_{2+}$ olefin. The pyrolysis conditions include a first gas temperature profile at $t_1$ which increases substantially monotonically from a first temperature ($T_1$) proximate to the first aperture to a second temperature ($T_2$) proximate to the second aperture, with $T_2$ being in the range of from 800° C. to 1400° C. Since the pyrolysis is on average endothermic, carrying out the pyrolysis cools the reactor, resulting in a second gas temperature profile at $t_2$ which exhibits a temperature $T_3$ proximate to the first aperture and $T_4$ proximate to the second aperture, wherein $T_3$ is $\leq T_1$ and $T_4$ is in the range of from $T_2$ to ($T_2$−100° C.). During the pyrolysis, the flow of the pyrolysis product is conducted into the second region of the internal volume via the second aperture, and away from the reactor via the second opening.

In other aspects the reactor and feed can be similar to those of the preceding aspects, but with a different temperature profiles. The pyrolysis is carried out during a pyrolysis time $t_P$, which has a duration ≥1 second. In these aspects, the pyrolysis conditions include a peak gas temperature $T_p$ located within the reactor, the peak gas temperature being positioned along $L_1$. At $t_1$ the reactor has a first bulk gas temperature profile which varies continuously along L from a first temperature ($T_1$) proximate to the first aperture to a second temperature ($T_2$) proximate to the second aperture, wherein $T_1<T_2$, $T_2<T_p$, and $T_2$ is in the range of from 800° C. to 1400° C. The reactor cools during $t_P$, resulting in a decrease $T_p$ and a second bulk gas temperature profile at $t_2$. During $t_P$, $T_p$ decreases by an amount that does not exceed 100° C., and the position of $T_p$ along $L_1$ remains substantially constant. Also during $t_P$, the flow of the pyrolysis product is conducted into the second region of the internal volume via the second aperture, and away from the reactor via the second opening. In any of the foregoing aspects, the reactor can be heated or reheated by combustion of fuel with oxidant during a heating mode al of time duration $t_H$.

In still other aspects, the invention relates to a regenerative pyrolysis reactor for carrying out any of the preceding aspects, and to the pyrolysis products produced by the pyrolysis of any of the preceding aspects.

DETAILED DESCRIPTION

Definitions

Figure 1:
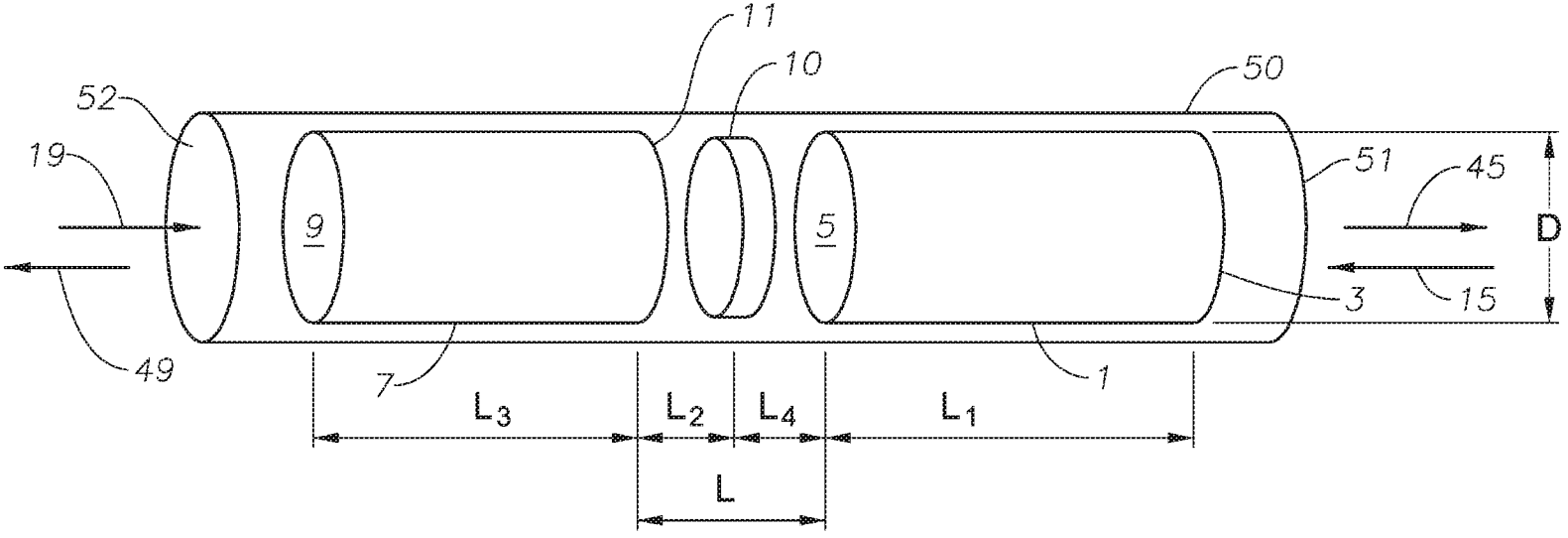
FIG. 1 schematically shows one form of a reverse flow reactor that is suitable for carrying out certain aspects of the invention.

For the purpose of this description and appended claims, the following terms are defined.

The term "$C_n$" hydrocarbon means hydrocarbon having n carbon atom(s) per molecule, wherein n is a positive integer. The term "$C_{n+}$" hydrocarbon means hydrocarbon having at least n carbon atom(s) per molecule. The term "$C_{n-}$" hydrocarbon means hydrocarbon having no more than n carbon atom(s) per molecule. The term "hydrocarbon" means a class of compounds containing hydrogen bound to carbon, and encompasses (i) saturated hydrocarbon. (ii) unsaturated hydrocarbon, and (iii) mixtures of hydrocarbons, and including mixtures of hydrocarbon compounds (saturated and/or unsaturated), such as mixtures of hydrocarbon compounds having different values of n.

The terms "alkane" and "paraffinic hydrocarbon" mean substantially-saturated compounds containing hydrogen and carbon only, e.g., those containing ≥1% (molar basis) of unsaturated carbon atoms. The term "unsaturate" and "unsaturated hydrocarbon" refer to one or more $C_{2+}$ hydrocarbon compounds which contain at least one carbon atom directly bound to another carbon atom by a double or triple bond. The term "olefin" refers to one or more unsaturated hydrocarbon compound containing at least one carbon atom directly bound to another carbon atom by a double bond. In other words, an olefin is a compound which contains at least one pair of carbon atoms, where the first and second carbon atoms of the pair are directly linked by a double bond. The term "aromatics" and "aromatic hydrocarbon" mean hydrocarbon compounds containing at least one aromatic ring.

The terms "reactor", "reactor system", "regenerator", "recuperator", "regenerative bed", "monolith", "honeycomb", "reactant", "fuel", and "oxidant" have the meanings disclosed in U.S. Pat. No. 7,943,808, which is incorporated by reference herein in its entirety. A "pyrolysis reactor" is a reactor, or combination of reactors or a system for hydrocarbon pyrolysis. The term "pyrolysis stage" means at least one pyrolysis reactor, and optionally including means for conducting one or more feeds thereto and/or one or more products away therefrom. A "region" or "zone" is a location, e.g., a specific volume, within a reactor, a location between two reactors and/or the combination of different disjointed locations in one or more reactors. A "pyrolysis region" is a location where pyrolysis is carried out, e.g., in a location which contains or is proximate to components, such as at least one thermal mass, which provides heat for the pyrolysis. A reactor or reaction stage can encompass one or more reaction regions. More than one reaction can be carried out in a reactor, stage, or region. The term open frontal area ("OFA") has the same meaning as in U.S. Pat. No. 5,494,881, which is incorporated by reference herein in its entirety.

A pyrolysis region can include components having conduits, channels, and passages. The term "conduit" refers to means for conducting a composition from one location to another. The term encompasses (i) elementary conducting means, such as a pipe or tube, and (ii) complex means such as tortuous pathways through conducting means, e.g., pipes, tubes, valves, and reactors, that are filled with random packing. The term "passage" means a geometrically contiguous volume element that can be utilized for conveying a fluid within a reactor, regenerator, recuperator, regenerative bed, monolith, honeycomb, etc. The term "channel" means a plurality of passages that can be utilized together for conveying a fluid within the reactor, regenerator, recuperator, regenerative bed, monolith, honeycomb, etc. For example, a honeycomb monolith can comprise a single channel, with the channel having a plurality of passages or sets of passages.

The term "bulk gas temperature" means the temperature of a bulk gas steam as measured by a device (such as a thermocouple) that is in contact with the bulk gas but not in contact with a solid thermal mass. For example, if the gas is traveling through an internal channel of length $L_c$ of a thermal mass in the pyrolysis zone of a thermal pyrolysis reactor, the bulk gas temperature at a location along $L_c$ is the average temperature (arithmetic mean) over the channel's cross sectional area at that location. The peak gas temperature is the greatest cross-sectional-averaged bulk gas temperature achieved along a flowpath. One skilled in the art will appreciate that a gas temperature immediately proximate to a solid thermal mass, such as a partition between passages within a thermal mass at any particular location may exceed the bulk gas temperature, and may, in some infinitesimal layer, actually approach the solid's temperature. The average bulk gas temperature "$T_{av}$" over a region of the reactor, e.g., of the pyrolysis zone, is obtained using the formula:

$$Tav = \left[\frac{1}{b-a}\int_a^b T(x)\,dx\right]$$

Parameters a and b are the boundaries of an interval (distance) along the long axis of the reactor. For example, referring to FIG. 1, parameter "a" can be the position of aperture 51 and parameter "b" can be the position of aperture 9. T(x) is a function representing the variation of bulk gas temperature over the interval of from a to b. When T(x) is a bulk gas temperature profile of a pyrolysis zone, e.g., the pyrolysis zones indicated (at the start of $t_P$) by the shaded regions in FIGS. 2-5, parameters a and b are the locations where the bulk gas temperature profile intersects the line $T_{MIN}$, which corresponds to the minimum temperature at which feed conversion is ≥10% under the selected pyrolysis conditions and feed. Since the bulk gas temperature profile typically changes during the pyrolysis time interval $t_P$, as shown in FIGS. 2-5, $T_{av}$ will typically decrease during $t_P$. The portion of the profile having a temperature $\geq T_{MIN}$ can be continuous, but this is not required. For example, when a profile that intersects $T_{MIN}$ at more than two locations in the pyrolysis zone (e.g., a, b) and touches $T_{MIN}$ at a location c (not shown, but between a and b), additional integrations are carried out, e.g.:

$$Tav = \frac{1}{b-a}\int_a^b T(x)\,dx + \frac{1}{c-b}\int_b^c T(x)\,dx.$$

When the portion of the profile that is $\geq T_{MIN}$ is in the form of discrete segments, the integrations are performed over each of the segments.

The term "selectivity" refers to the production (weight basis) of a specified compound in a reaction. As an example, the phrase "a hydrocarbon pyrolysis reaction has 100% selectivity for methane" means that 100% of the hydrocarbon (weight basis) that is converted in the pyrolysis reaction is converted to methane. When used in connection with a specified reactant, the term "conversion" means the amount of the reactant (weight basis) consumed in the reaction. For example, when the specified reactant is ethane, 100% conversion means 100% of ethane is consumed in the reaction. With respect to hydrocarbon pyrolysis the term "conversion" encompasses any molecular decomposition by at least pyrolysis heat, including cracking, breaking apart, and reformation. Average conversion in a reaction zone, e.g., a pyrolysis zone, is the conversion achieved at $T_{av}$. Yield (weight basis) is conversion times selectivity.

The term "pyrolysis" means an endothermic reaction for converting molecules into (i) atoms and/or (ii) molecules of lesser molecular weight, and optionally (iii) molecules of greater molecular weight, e.g., processes for converting ethane and/or propane to molecular hydrogen and unsaturates such as ethylene, propylene and acetylene. Certain aspects of the invention feature a pyrolysis zone exhibiting selectivities (e.g., of desired products) which vary as a function of position along the length of the pyrolysis zone but which do not vary appreciably as a function time during pyrolysis mode, e.g., within about +/−25%, such as +/−10%, or +/−5% from selectivity at the start of $t_P$. More particularly, for certain aspects in which $T_{av}$ and/or $T_p$ decrease by ≤100° C. during pyrolysis mode, the yield of many desired products, e.g., light olefin yield, such as ethylene and/or propylene yield, do not vary appreciably as a function of time during pyrolysis mode even though the product selectivities vary as a function of position along the length of the pyrolysis zone. For example, yield is typically within about +/−25%, such as +/−10%, or +/−5% of yield at the start of $t_P$. In these aspects, average conversion might not vary appreciably as a function of time during pyrolysis mode, and is typically within about +/−25%, such as +/−10%, or +/−5% of average conversion at the start of $t_P$.

A hydrocarbon feed is subjected to "thermal pyrolysis" when <50.0% of the heat utilized by the pyrolysis is provided by exothermically reacting the hydrocarbon feed, e.g., with an oxidant. The "severity threshold temperature" for pyrolysis is the lowest bulk gas temperature at which acetylene selectivity is at least 10% for a residence time ≥0.1 second. High-severity pyrolysis conditions are those carried out at a peak gas temperature that is greater than or equal to the severity threshold temperature. Low-severity pyrolysis conditions are those carried out at a peak gas temperature that is less than the severity threshold temperature, i.e. conditions under which substantially no hydrocarbon pyrolysis is carried out at a pyrolysis gas temperature that exceeds the severity threshold temperature. High-severity conditions include those which exhibit (i) a methane selectivity ≥5 wt. % and/or (ii) a propylene selectivity at a temperature ≥1000° C. of ≤0.6 wt. %. With respect to pyrolysis reactors, the term "residence time" means the average time duration for non-reacting (non-converting by pyrolysis) molecules (such as He, $N_2$, Ar) having a molecular weight in the range of 4 to 40 to traverse a pyrolysis region of a pyrolysis reactor.

The term "Periodic Table" means the Periodic Chart of the Elements, as it appears on the inside cover of The Merck Index, Twelfth Edition, Merck & Co., Inc., 1996.

Certain aspects of the invention relate to carrying out pyrolysis mode and heating mode under the specified conditions in one or more reverse flow reactors. Representative reverse flow reactors will now be described in more detail with respect to FIG. 1. The invention is not limited to these aspects, and this description is not meant to foreclose the use of other reactors within the broader scope of the invention.

Representative Reverse Flow Reactors

Reverse-flow reactor 50 can be in the form of an elongated tubular vessel having an internal volume which includes a pyrolysis zone for carrying out the pyrolysis. Typically, the internal volume includes three zones: a first heat-transfer zone, a second heat transfer zone, with the pyrolysis zone being located between the first and second heat transfer zones. The zones are in fluidic communication with one another. The reactor vessel's cross sectional shape and/or cross sectional area can be substantially uniform over the length of the reactor, but this is not required. For example, one or more segments of the reactor vessel's length can have a circular, elliptical, or polygonal cross section. Reactor 50 has opposed first and second openings 51 and 52 which are in fluidic communication with the internal volume and are located at terminal ends of the reactor vessel.

The reactor 50 includes first and second thermal masses 1 and 7 for transferring heat to/from reactants and products during the pyrolysis and heating modes. Typically, the thermal mass comprises bedding or packing material that is effective in storing and transferring heat, such as glass or ceramic beads or spheres, metal beads or spheres, ceramic (e.g., ceramics, which may include alumina, yttria, and zirconia) or honeycomb materials comprising ceramic and/or metal, other forms of tubes comprising ceramic and/or metal, extruded monoliths and the like. The thermal masses and regenerative beds containing thermal masses can be channeled members comprising refractory, e.g., those described in U.S. Pat. Nos. 8,754,276; 9,126,882; 9,346,728; 9,187,382; 7,943,808; 7,846,401; 7,815,873; 9,322,549; and in U.S. Patent Application Publications Nos. 2007-0144940, 2008-300438, 2014-303339, 2014-163287, 2014-163273, 2014-0303416, 2015-166430, 2015-197696, and 2016-176781. These references are incorporated by reference herein in their entireties. It has been found that in order to keep $T_p$ and/or $T_{av}$ from decreasing by no more than about 100° C., and preferably ≤75° C. during $t_P$ under a wide range of pyrolysis conditions, the OFA of at least thermal mass 1 should be ≤55%, e.g., ≤45%, such as ≤40%, or ≤35%. Although thermal masses having a very small OFA are within the scope of the invention, it has been found that an OFA of less than about 25%, and particularly less than about 10%, can result in an undesirably large pressure drop across the reactor. Typically, the OFA of thermal mass 1 is in the range of about 10% to 55%, e.g., 10% to 50%, such as 10% to 45%, or 10% to 35%.

The thermal mass typically has a thermal conductivity in the range of from 0.5 W/m° K to 50 W/m° K, a coefficient of thermal expansion in the range of from $1\times10^{-7}$/° K to $2\times10^{-5}$/° K, and an average wetted surface area per unit volume in the range of from 1 $cm^{-1}$ to 100 $cm^{-1}$. The internal channel of the first thermal mass typically includes a plurality of substantially parallel passages, e.g., at a passage density in the range of from 77000/$m^2$ to $1.3\times10^6$/$m^2$. The thermal mass comprises refractory, the refractory generally having a specific heat capacity at 300° K that is ≥0.04 [kj/(° K kg)] and a mass density ≥3000 kg/$m^3$. For example, the refractory's specific heat capacity at 300° K can be in the range of from 0.04 [kj/(° K kg)] to 1.2 [kj/(° K kg)], and its mass density can be in the range of from 3000 kg/$m^3$ to 5000 kg/$m^3$.

The choice of refractory composition is not critical, provided it is capable of surviving under pyrolysis mode and heating mode conditions for practical run lengths (e.g., months) without significant deterioration or decomposition.

Those skilled in the art will appreciate that the compositions of the first and second thermal masses should be selected from among those that substantially maintain integrity (structural and compositions) and functionality during long term exposure to pyrolysis feeds, products, and reaction conditions, e.g., temperatures ≥750° C., such as ≥1200° C., or for increased operating margin ≥1500° C. Conventional refractories can be used, including those comprising at least one oxide of one or more elements selected from Groups 2-14 of the Periodic Table, but the invention is not limited thereto. In particular aspects, the refractory includes oxide of at least one of Al, Si. Mg, Ca, Fe, Mn, Ni, Co, Cr, Ti, Hf, V, Nb, Ta, Mo, W, Sc, La, Yt, Zr, and Ce. Alternatively or in addition, the refractory can include non-oxide ceramic.

Generally, a first segment of the first thermal mass 1 is located in the first heat transfer zone, with a second segment being located in the pyrolysis zone. Likewise, a first segment of the second thermal mass can be located in the second heat transfer zone, with a second segment being located in the pyrolysis zone. Typically, thermal masses 1 and 7 have the form of an elongated tubular member comprising refractory and having at least one internal channel and opposed apertures in fluidic communication with the internal channel(s). Thermal mass 1 has a length $L_1$ (i.e., $L_1=L_M$), and typically $L_1$ is substantially the same as the length of the internal channel, $L_c$. Thermal mass 7 has a length $L_3$, and typically $L_3$ is substantially the same as the length of the internal channel, $L_c$. $L_1$ (and also typically $L_3$) is $\geq 0.1*L_R$, e.g., in the range of from $0.1*L_R$ to $0.9*L_R$ such as $0.1*L_R$ to $0.4*L_R$. Optionally, $L_3$ is of substantially the same length as $L_1$, and is of substantially the same cross-sectional shape and of substantially the same cross sectional area. As shown in FIG. 1, thermal mass 1 includes first and second apertures 3 and 5, and thermal mass 7 includes first and second apertures 9 and 11. Aperture 3 is proximate to opening 51. Optionally, particularly in aspects (not shown) in which thermal mass 7 is omitted, aperture 5 can be proximate to opening 52. Thermal masses 1 and 7 can each have the form of an elongated honeycomb comprising at least one channel, the channel having a plurality of passages. When a thermal mass is a segmented thermal mass, the honeycombs can be arranged adjacent to one another (e.g., end-to-end, in series). As may be appreciated, it is desirable. e.g., to lessen reactor pressure drop, to a align passages of a honeycomb's internal channel or channels with those of neighboring honeycombs to facilitate fluidic communication through the thermal mass. Optionally, the segments are of substantially the same composition, shape, cross sectional area, and have substantially the same total number of passages and the same number of passages per unit area.

The internal volume of reactor 50 also includes a combustion zone. e.g., between terminal segments of the first and second thermal masses. Although combustion zone can occupy less than all of the region between apertures 5 and 11, it is within the scope of the invention for the combustion zone to include all of the reactor's internal volume between apertures 5 and 11, e.g., the entire length L shown in FIG. 1. Typically, however, the combustion zone is centered in the region between apertures 11 and 5, e.g., with $L_2$ being substantially equal to $L_4$. As may be appreciated, the combustion zone occupies a region of reactor 50's internal volume during $t_H$ that is within the pyrolysis zone during $t_P$. However, since in the aspects illustrated in FIG. 1, a heating mode is not carried out at the same time as pyrolysis mode, appreciable combustion does not occur in the combustion zone during pyrolysis and appreciable pyrolysis does not occur in the pyrolysis zone during heating.

The combustion zone is typically configured for (i) mixing the fuel and a portion of the oxidant during heating mode for efficient combustion, (ii) increasing distribution uniformity over third zone's internal cross sectional area of the combustion products, unreacted oxidant, and optionally unreacted fuel, and (iii) lessening undesirable pressure-drop effects during pyrolysis mode. The combustion zone can have the form of an open volume within the internal volume of reactor 50, e.g., an open volume having a length L and substantially constant circular cross section of diameter D and cross sectional area A (not shown). As may be appreciated, an open volume having an appropriate L:A ratio will provide at least some mixing and distribution during heating mode without creating too great a pressure drop during pyrolysis mode. More typically, since it provides improved mixing and distribution and allows a lesser overall length for the combustion zone, the combustion zone includes at least one mixer-distributor apparatus 10. The mixer-distributor, which can have the form of a relatively thin member (e.g., a plate) having one or more orifices effective for carrying out the mixing and distribution during heating mode. Generally, the orifices have sufficient cross sectional area to prevent an undesirably large pressure drop across the third zone during pyrolysis mode. Conventional mixer-distributors can be used, such as those described in U.S. Patent Application Publication No. 2013-0157205 A1 and U.S. Pat. No. 7,815,873 (incorporated by reference herein in their entireties), but the invention is not limited thereto. Optionally, the combustion zone contains at least one selective combustion catalyst. Suitable selective combustion catalysts are described in U.S. Pat. No. 8,754,276, but the invention is not limited thereto. When used, a fixed bed of the selective combustion catalyst can be included as a component of mixer-distributor 10, e.g., with one or more of the mixer-distributor's plate members serving as a catalyst support. When used, the mixer-distributer can be located at any location within the combustion zone. Typically, however, it is located approximately midway between apertures 11 and 5. In certain aspects, however, such as those where the amount of coke deposits in thermal mass 1 exceed that of thermal mass 7, the combustion zone is shifted downstream (with respect to fuel-oxidant flow) toward thermal mass 1. The amount of shift is typically ≤25% of L, e.g., ≤20%, such as ≤10%.

The sum of lengths $L_1$, L, and $L_3$ is typically ≥90% of the total length of reactor 50 ($L_R$), e.g., as measured between openings 51 and 52. Since it is desirable to direct fuel and oxidant flows into appropriate passages of thermal mass 7 during heating mode and to direct pyrolysis feed flow into appropriate passages of thermal mass 1 during pyrolysis mode, it is typically desired to limit the internal volume between aperture 9 and opening 52 and between aperture 3 and opening 51, to that needed for convenient reactor assembly and to prevent component interference as might otherwise occur from thermal expansion during use. For, example, the distance along the flow path between aperture 9 and opening 52 is typically $\leq 0.1\ L_R$, such as $\leq 0.01\ L_R$, or $\leq 0.01\ L_R$. Likewise, the distance along the flow path between aperture 3 and opening 51 is typically $\leq 0.1\ L_R$, such as $\leq 0.01\ L_R$, or $\leq 0.01\ L_R$. The pyrolysis zone, which generally encompasses all of region L, a segment of $L_1$, and a segment of $L_3$, is typically ≥10% of the total length of reactor 50, e.g., ≥15%, such as ≥20%. It is also typical for the pyrolysis zone to encompass ≥80% of the total length of reactor 50, e.g., to leave sufficient internal volume of thermal mass 1 for pre-heating the pyrolysis feed and sufficient internal volume of thermal mass 7 for quenching the pyrolysis product, e.g., ≤60%, such as ≤40%. In certain aspects, the pyrolysis zone has a length in the range of from 10% to 60% of the total length of the reactor, e.g., in the range of from 20% to 40%. The combustion zone's length L is typically ≤50% of that of the length of the pyrolysis zone, e.g., ≤40%, such as ≤30%, or ≤20%.

Values for L, $L_1$, $L_2$, $L_3$, $L_1$, and D generally depend on the pyrolysis feed used and the rate at which it is conducted into the reactor, the fuel and oxidant compositions, and the rate at which these are conducted into the reactor, etc. Although larger and small reactors are within the scope of the invention, (i) D is typically ≤1 cm, e.g., in the range of from about 1 cm to 10 m, such as 0.1 m to 7.5 m, (ii) $L_R$ is typically ≥1 cm, e.g., in the range of from about 1 cm to 20 m, such as 0.1 m to 7.5 m, (iii) L is typically ≤25% of $L_R$, e.g., ≤10%, (iv) $L_1$ is typically ≥35% of $L_R$ e.g., ≥45%, (v) $L_3$ is typically ≥35% of $L_R$, e.g., ≥45%, $L_3$ being optionally of substantially the same size and shape as $L_1$, and (vi) $L_2$ is typically within about +/−25% of L, e.g., +/−10%, such as +/−5%.

In certain aspects (not shown) at least a portion of the fuel-oxidant combustion is carried out in a location other than within the internal volume of reactor 50. For example, fuel combustion can be carried out at a location external to reactor 50, with the combustion products, unreacted oxidant, and optionally unreacted fuel being conveyed to the vicinity of the pyrolysis zone for (i) heating the pyrolysis zone to provide a desired temperature profile for efficiently carrying out the pyrolysis and (ii) combusting catalyst coke deposits with at least a portion of the unreacted oxidant.

In aspects illustrated schematically in FIG. 1, reactor 50 is heated during heating mode by conveying a heating mixture 19 comprising fuel and oxidant through opening 52, through aperture 9 of thermal mass 7, and out of aperture 11 toward the combustion zone. Typically, the fuel and oxidant are conveyed separately through different channels of thermal mass 7 from aperture 9 toward aperture 11, and are combined to form the heating mixture downstream (with respect to fuel/oxidant flow) of thermal mass 7. Typically fuel and oxidant are heated by a transfer of heat from thermal mass 7 as the fuel and oxidant flow through the channels of thermal mass 7. Combustion of the fuel and oxidant produces a combustion product. Combustion product, any un-combusted oxidant, and any un-combusted fuel enter aperture 5. When there is un-combusted oxidant in thermal mass 1, this can react with coke deposits and any un-combusted fuel to produce additional combustion product. An aggregated combustion product 45 is conducted out of aperture 3 and away from the reactor via opening 51. The aggregate combustion product typically comprises the combustion product produced in the combustion zone, additional combustion product, typically from combustion of coke in passages of thermal mass 1; and any unreacted fuel and/or any unreacted oxidant. Reactor 50 is switched from heating mode to pyrolysis mode after achieving the desired reactor temperature profile.

Continuing with reference to FIG. 1, a flow of pyrolysis feed 15 is conducted into reactor 50 during pyrolysis mode via opening 51. The pyrolysis feed is preheated in an upstream segment of thermal mass 1 and is typically pyrolysed in (i) a downstream segment of thermal mass 1, and optionally also in (ii) the region between thermal mass 1 and thermal mass 7 and (iii) in an upstream segment of thermal mass 7, upstream and downstream now being with respect to the flow of feed and pyrolysis product. A volatile portion 49 (typically gaseous) of the pyrolysis product is cooled in a downstream segment of thermal mass 7, and is conducted away from thermal mass 7 via aperture 9, and is conducted away from reactor 50 via opening 52. A non-volatile portion of the pyrolysis product remains in the reactor, typically as coke deposits. Accumulation of coke deposits in reactor 50 is lessened by combusting deposited coke during heating mode.

Heating mode is carried out for a time interval of duration $t_H$ to achieve a desired temperature profile in the internal volume of reactor 50 for the start of pyrolysis mode, primarily by fuel-oxidant combustion in combustion zone 10, coke-oxidant combustion in passages of thermal masses 1 and 7, and optionally additional fuel-oxidant combustion in internal passages of thermal mass 1 and (less typically) thermal mass 7. Pyrolysis mode is carried out for a time interval of duration $t_P$. Pyrolysis is endothermic, and, consequently, the bulk gas temperature profile of reactor 50 is transformed over the course of time interval $t_P$ to a profile that is not appropriate for efficient pyrolysis. Reactor 50 is then switched from pyrolysis mode to heating mode to reheat the reactor, so that the desired bulk gas temperature profile is exhibited at the start of a following pyrolysis mode. Typically, valve means (e.g., a plurality of valves, and at least one flow controller are provided to (i) establish forward flows of the pyrolysis feed and the pyrolysis product during pyrolysis mode for a time duration $t_P$ and (ii) establish reverse flows of the fuel, the oxidant, and the combustion product during heating mode for a time duration $t_H$.

Pyrolysis mode and heating mode are typically repeated in sequence, for semi-continuous or continuous operation. Intervening steps between successive pyrolysis and heating modes, e.g., one or more steps for admitting a forward or reverse flow of sweep gas to the reverse-flow reactor, can be carried out between pyrolysis mode and heating mode operation, and vice versa. Continuous or semi-continuous operation can be characterized by a "cycle time", which constitutes the time duration from the start of a pyrolysis mode to the start of the next pyrolysis mode in the sequence, and includes the time duration of heating mode(s) and any intervening steps (when used). Cycle time can be substantially constant over a plurality of repeated cycles, but this is not required. The invention is typically practiced with relatively short cycle times compared to that of conventional processes (e.g., steam cracking) for pyrolysing similar feed hydrocarbon at a peak pyrolysis temperature ≤1200° C. For example, cycle time can be ≤60 seconds, e.g., ≥30 seconds, such as ≤15 seconds, or ≤5 seconds. Typically, cycle time is in the range of from 2 seconds to 60 seconds, e.g., 3 second to 30 seconds, such as 4 second to 30 seconds. When (i) the pyrolysis feed is introduced into the reactor in a direction that is substantially opposite to the direction of fuel and oxidant flow and/or (ii) when the flow of pyrolysis product away from the reactor is substantially opposite to the direction of combustion product flow, the reactor is called a reverse-flow reactor.

Certain aspects of heating mode operation, during which reactor 50 is preheated for initial pyrolysis mode operation, or reheated for continued pyrolysis mode operation, will now be described in more detail. The invention is not limited to these aspects, and this description is not meant to foreclose other ways to operate a heating mode.

Representative Heating Mode Conditions

Operating conditions during heating mode are selected to accomplish (i) reheating the pyrolysis zone to establish a temperature profile in the reactor corresponding to the desired bulk gas temperature profile at the start of a following pyrolysis mode and (ii) removing sufficient coke deposits from within the reactor's internal volume, which would otherwise lead to an increase in reactor pressure drop. When it is desired to quench the pyrolysis product within the reactor, heating mode optionally includes cooling thermal mass within the reactor at a location that is both upstream (with respect to fuel-oxidant flow) of the combustion zone and downstream (with respect to the flow of pyrolysis product) of the pyrolysis zone.

Combustion is carried out during heating mode by reacting fuel and oxidant, e.g., fuel and oxidant contained in a heating mixture. The fuel and oxidant can be the same as those disclosed in U.S. Pat. No. 7,943,808. Optionally, the fuel is derived from, comprises, consists essentially of, or consists of one or more of hydrogen, CO, methane, methane containing streams, such as coal bed methane, biogas, associated gas, natural gas and mixtures or components thereof, etc. The fuel typically comprises one or more of molecular hydrogen, synthesis gas (mixtures of CO and $H_2$), and hydrocarbon, such as ≥10.0 wt. % hydrocarbon, or ≥50.0 wt. % hydrocarbon, or ≥90.0 wt. % hydrocarbon. The oxidant is typically one or more of molecular oxygen, ozone, and air, including molecular oxygen in air. Those skilled in the art will appreciate that feed flow rate will depend on factors such as feed composition, reactor volume, pyrolysis conditions, etc. Accordingly, the invention can be carried out over a very wide range of heating mixture flow rates, e.g., at a flow rate ≥0.001 kg/s, such as ≥0.1 kg/s, or ≥10 kg/s, or ≥100 kg/s, or more.

Once a fuel of the desired caloric content (heating value) has been selected, the amounts of fuel and oxidant conducted to the reactor during heating mode can be specified in terms of the amount of oxidant needed for combusting the accumulated coke deposits ("$OC_a$") and the amount of oxidant ("$OC_b$") needed for the substantially stoichiometric combustion of the fuel. Typically, the amount of oxidant supplied during heating mode is $Z.(OC_a+OC_b)$, wherein Z is generally ≥0.5, e.g., ≥0.8, such as in the range of 0.5 to 5.0, or 0.5 to 3.0, or 0.8 to 3.0. The amounts $OC_a$ and $OC_b$ are on a molar basis. When Z>1.0, the excess oxidant can be utilized, e.g., for one or more of removing at least a portion of any accumulated coke deposits, moderating the reaction temperature during heating mode (as disclosed in U.S. Pat. No. 7,943,808), and conveying heat within the reactor from one zone to another. Generally, a first portion of the oxidant is combusted with the fuel in the combustion zone, and a second portion is combusted with accumulated coke deposits. Typically, the first portion comprises ≥50 wt. % of the total amount of oxidant supplied during heating mode, e.g., ≥75 wt. %, or ≥90 wt. %, with the second portion comprising at least 75 wt. % of the remainder of the total oxidant. e.g., ≥90 wt. %. It is also typical for oxidant flow rate and fuel flow rate to remain substantially constant for the duration of heating mode. These flow rates are selected to achieve the desired amount of combustion heating and the desired amount of coke removal during $t_H$. The invention is compatible with conventional methods for lessening coke accumulation in thermal masses during heating mode, e.g., those described in U.S. Pat. No. 9,187,382, which is incorporated by reference in its entirety.

Other streams can be provided to the reactor during heating mode, e.g., one or more diluent streams can be provided, such as by addition to the heating mixture. When used, diluent can be provided with the oxidant and/or fuel. Suitable diluents (which can be a diluent mixture) include one or more of, e.g., oxygenate (water, carbon dioxide, etc.), non-combustible species, such as molecular nitrogen ($N_2$), and fuel impurities, such as hydrogen sulfide. For example, the oxidant can comprise 60.0 mole % to 95.0 mole % diluent and 5.0 mole % to 30.0 mole % molecular oxygen per mole of the oxidant, such as when the oxidant is air. Optionally, the oxidant has a mass ratio of diluent to molecular oxygen in the range of 0.5 to 20.0, e.g., in the range of 4.0 to 12.0.

In order to lessen or prevent the occurrence of a sharp temperature gradient in the bulk gas temperature profile at the start of pyrolysis mode and during the course of pyrolysis mode, it was expected that a relatively long-duration $t_H$ would be needed, e.g., a $t_H$≥30 seconds, or ≥50 seconds. Surprisingly, this is not the case: a $t_H$≤27 seconds is typically sufficient for reheating the reactor to achieve the desired bulk gas temperature profile at the start of pyrolysis mode, e.g., ≤25 second, such as ≤10 seconds, or ≤1 second, or ≤0.1 second. For example, $t_H$ can be in the range of from 0.01 second to 25 seconds, or 0.05 second to 10 seconds, or 0.05 second to 5 seconds, or 0.05 second to 1 second.

It was also expected that fuel-oxidant combustion should be distributed through the reactor's pyrolysis zone to achieve the desired non-constant bulk gas temperature profile in the pyrolysis zone during $t_P$, and to lessen or prevent the occurrence of a sharp temperature gradient in the bulk gas temperature profile during $t_P$. Surprisingly, it has been found that this is not the case. The desired bulk gas temperature profile for pyrolysis mode is established during heating mode by carrying out fuel-oxidant combustion primarily in the central region of the reactor (e.g., a region of length L as shown in FIG. 1). While not wishing to be bound by any theory model, it is believed that concentrating combustion in the central region of the reactor leads to an improved reactor temperature profile compared to that which is achieved by distributed combustion for mainly two reasons. First, the greater fuel and oxidant flow rates needed to achieve the desired amount of combustion during $t_H$, and the resulting increased flow rate of combustion product, leads to more favorable distribution of combustion heat within the reactor. Second, during heating mode the combination of radiative heat transfer to a thermal mass proximate to the combustion zone and heat conduction within the thermal mass sufficiently moderates the reactor temperature profile so as to broaden temperature gradients in the pyrolysis zone (e.g., gradients along the length of the reactor) that would otherwise be undesirably sharp.

Referring again to FIG. 1, an appropriate combustion zone of length L can be achieved by conventional methods, e.g., by use of one or more mixer-distributors, use of a selective combustion catalyst, etc. For example, it has been found that even when mixer-distributors and selective combustion catalysts are not used, limiting Z to a value ≤5.0, e.g., ≤3.0, and especially <2.0, results in a combustion zone length L that is ≤50% of that of the length of the pyrolysis zone, e.g., ≤40%, such as ≤30%, or ≤20%.

After the reactor is sufficiently reheated to establish the reactor temperature profile desired at the start of pyrolysis, the reactor can be switched from heating mode to pyrolysis mode, typically by decreasing or terminating fuel and oxidant flow and commencing or increasing a flow of pyrolysis feed. Representative pyrolysis feeds will now be described in more detail. The invention is not limited to these pyrolysis feeds, and this description is not meant to foreclose the use of other pyrolysis feeds within the broader scope of the invention.

Representative Pyrolysis Feeds

The pyrolysis feed comprises $C_{2+}$ hydrocarbon, e.g., ≤1 wt. % of $C_{2+}$ hydrocarbon, such as ≥10 wt. %, or ≥25 wt. %, or ≥50 wt. %, or ≥75 wt. %, or ≥90 wt. %. Typically ≥90 wt. % of the remainder of the pyrolysis feed comprises diluent, e.g., one or more of methane, $CO_2$, water, etc. In certain aspects, the pyrolysis feed consists essentially of or even consists of $C_{2+}$ hydrocarbon, e.g., $C_2$-$C_9$ paraffinic hydrocarbon. The pyrolysis feed's hydrocarbon (the "feed hydrocarbon") generally includes any hydrocarbon compounds or mixture of hydrocarbon compounds that when subjected to the specified pyrolysis conditions produce the desired pyrolysis product. Suitable pyrolysis feeds include those disclosed in U.S. Patent Application Publication No. 2016-176781, which is incorporated by reference herein in its entirety. In certain aspects, particularly those aspects where the feed comprises ≥50 wt. % ethane (or propane, or a mixture of ethane and propane), e.g., ≥75 wt. %, such as ≥90 wt. %, conversion during pyrolysis is based on the amount of $C_{2+}$ hydrocarbon that is converted. In other aspects. e.g., those where the feed includes components such as (i) saturated $C_{4+}$ hydrocarbon and/or (ii) aromatic and/or non-aromatic cores having one or more substantially-saturated $C_{2+}$ side chains, the conversion is based on the aggregate amount of $C_{2+}$ hydrocarbon components converted, including such substantially saturated side chains as may be converted.

Although the feed hydrocarbon typically includes $C_{2+}$ compounds which contain hydrogen and carbon only, feed hydrocarbon can contain compounds having covalently-bound and/or non-covalently-bound heteroatoms. When present in the feed hydrocarbon, the amount of such heteroatom-containing hydrocarbon compounds is typically ≥10 wt. % based on the weight of the feed's hydrocarbon. Feed hydrocarbon that is substantially-free of non-aliphatic hydrocarbon is within the scope of the invention, as is feed hydrocarbon that is substantially free of aromatic hydrocarbon and/or substantially free of olefinic hydrocarbon, particularly $C_2$-$C_5$ olefin. Substantially-free in this context means <1 wt. % based on the weight of the feed hydrocarbon, such as ≤0.1 wt. %, or ≤0.01 wt. %, or ≤0.001 wt. %.

The feed hydrocarbon can be obtained from one or more sources of hydrocarbon, e.g., from natural hydrocarbon sources including those associated with producing petroleum, or from one or more synthetic hydrocarbons sources such as catalytic and/or non-catalytic reactions. Examples of such reactions include catalytic cracking, catalytic reforming, coking, steam cracking, etc. Synthetic hydrocarbon sources include those in which hydrocarbon within a geological formation has been purposefully subjected to one or more chemical transformations. The feed can include a recycled portion of the pyrolysis product. Such recycle, when used, can include, e.g., methane, molecular hydrogen, and $C_{2+}$ hydrocarbon, typically $C_2$ to $C_5$.

The feed hydrocarbon can include one or more of ethane, propane, butanes, saturated and unsaturated $C_6$ hydrocarbon, including those derived from one or more of Fischer-Tropsch synthesis products, shale gas, biogas, associated gas, natural gas and mixtures or components thereof, steam cracked gas oil and residues, gas oils, heating oil, jet fuel, diesel, kerosene, gasoline, naphtha (including coker naphtha, steam cracked naphtha, and catalytically cracked naphtha), hydrocrackate, reformate, raffinate reformate, Fischer-Tropsch liquids, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, synthetic crudes, shale oils, coal liquefaction products, coal tars, tars, atmospheric resid, heavy residuum, $C_4$-residue admixture, naphtha-residue admixture, cracked feed, coker distillate streams, and hydrocarbon streams derived from plant or animal matter. The feed hydrocarbon can comprise volatile and non-volatile hydrocarbon, as described in U.S. Patent Application Publication No. 2016-176781. Those skilled in the art will appreciate that feed flow rate will depend on factors such as feed composition, reactor volume, pyrolysis conditions, etc. Accordingly, the invention can be carried out over a very wide range of feed flow rates, e.g., at a flow rate ≥0.001 kg/s, such as ≥0.1 kg/s, or ≥10 kg/s, or ≥100 kg/s, or more.

Although the invention is not limited thereto, the specified process can be used for upgrading relatively refractory hydrocarbon, such as ethane, aromatic hydrocarbon, and resid. Accordingly, the feed hydrocarbon can comprise refractory hydrocarbon in an amount ≥1 wt. %, e.g., ≥5 wt. %, such as ≥10 wt. %. Suitable feeds include those comprising >50 wt. % refractory hydrocarbon, such as ≥75 wt. %, or ≥90 wt. %, or ≥95 wt. %. For example, the feed can comprise an amount of refractory hydrocarbon in the range of from 1 wt. % to 99 wt. %, such as 5 wt. % to 95 wt. %, or 10 wt. % to 90 wt. %. One representative feed hydrocarbon comprises (i) ≥10 wt. % ethane, or ≥50 wt. %, or ≤90 wt. %, such as in the range of from 10 wt. % to 99.5 wt. % ethane, with ≥95 wt. % of the balance of the feed hydrocarbon comprising one or more of methane, propane, and butanes. In other aspects, the feed comprises ≥90 wt. % of (i) ethane and/or (ii) propane. The light paraffinic hydrocarbon can be provided from any convenient source, e.g., from synthetic and/or natural sources. Light paraffinic hydrocarbon ethane can be provided from petroleum or petrochemical processes and/or sources of geological origin, e.g., natural gas. In particular aspects, the pyrolysis feed comprises ≥90 wt. % of (i) ethane and/or (ii) propane.

The pyrolysis feed optionally includes diluent, typically comprising compositions that are essentially non-reactive under the specified pyrolysis conditions, such as one or more of methane, water (e.g., steam), hydrogen, nitrogen and the noble gases, such as helium, neon and argon. Diluent present in the pyrolysis feed's source (e.g., methane and/or $CO_2$ present in natural gas) and diluent added to the pyrolysis feed are within the scope of the invention. Diluent, when present, is typically included in the pyrolysis feed in an amount ≤60 wt. % based on the weight of the feed, e.g., ≤50 wt. %, such as ≤≤40 wt. %, or ≤30 wt. %, or ≤20 wt. %, or ≤10 wt. %, or in the range of from 1 wt. % to 50 wt. %. Diluent is also suitable for use as a sweep gas, e.g., for (i) removing at least a portion of any deposits in the reactor after the pyrolysis mode and/or after heating mode and/or (ii) adjusting the reactor's temperature profile—heat carried by the sweep gas from warmer regions of the reactor for transfer to cooler regions will increase the temperature of the cooler regions and further lessen or prevent sharp gradients in the reactor temperature profile.

A flow of the pyrolysis feed is conducted to the pyrolysis reactor during pyrolysis mode, typically in a reverse-flow direction, e.g., one that is opposed to that of oxidant flow. During pyrolysis mode, at least a portion of the feed hydrocarbon is pyrolysed to produce a desired pyrolysis product. Certain pyrolysis conditions that are useful for pyrolysing the specified pyrolysis feeds will now be described in more detail. The invention is not limited to these pyrolysis conditions, and this description is not meant to foreclose the use of other pyrolysis conditions within the broader scope of the invention.

Representative Pyrolysis Mode Conditions

When heating mode is carried out under the specified conditions, the bulk gas temperature profile at the start of pyrolysis mode continuously varies over the length of the pyrolysis zone. Utilizing a first thermal mass having an OFA≤55% in a pyrolysis reactor operating under the specified pyrolysis conditions has been found to result in a number of favorable features, e.g., a feed conversion that is typically ≥50 wt. % and desirable olefin yields, typically without excessive coke yield. Although $T_P$ and $T_{av}$ decreases during the course of the pyrolysis, the position of $T_p$ along the length of the pyrolysis zone and the general shape of the bulk gas temperature profile typically remain substantially the same during $t_P$. More particularly, utilizing a first thermal mass having an OFA in the specified range results in a decrease in $T_p$ and/or $T_{av}$ that are each ≤100° C. during the course of the pyrolysis, e.g., ≤75° C., such as ≤50° C., or ≤25° C., or ≤10° C., or ≤5° C., for a wide range of pyrolysis conditions and a wide selection of pyrolysis feeds. In certain aspects, e.g., those where $T_p$ is located downstream of the first thermal mass, the bulk gas temperature proximate to the downstream end of the first thermal mass decreases by ≤100° C. during the course of the pyrolysis, e.g., ≤75° C., such as ≤50° C., or ≤25° C., or ≤10° C., or ≤5° C. Regions of substantially-constant temperature along the length of the pyrolysis zone are avoided. Sharp gradients in the bulk gas temperature profile within the pyrolysis zone are also substantially avoided. Although high-severity pyrolysis conditions can be used, it is typical to use low severity conditions.

When OFA is in the specified range, $T_p$ and/or $T_{av}$ remain within 100° C. of their values at the start of the pyrolysis even $t_P$ is of relatively long duration, e.g., ≥1 second, such as ≥2 seconds, or ≥5 seconds, or ≥10 seconds, or ≥20 seconds, or ≥30 seconds, or even ≥1 minute or more. For example, $t_P$ can be in the range of from 1 second to 30 seconds, e.g., 2 seconds to 15 seconds, such as 2 seconds to 10 seconds. Conventional methods can be used to achieve these ranges of $t_P$, e.g., using one or more poppet valves and/or hydrodynamic valving, but the invention is not limited thereto. The bulk gas temperature profile typically maintains a substantially constant shape (although decreasing in magnitude) during these relatively long $t_P$ values. Using a $t_P \geq 2$ seconds and the specified OFA lessens the appearance of pyrolysis zone segments having a substantially-constant bulk gas temperature profile. Using these $t_P$ values and the specified OFA also substantially prevents relatively sharp temperature gradients in the pyrolysis zone. For example, at any time during the pyrolysis variations in the bulk gas temperature are typically ≤140° C. within any pyrolysis zone segment having a length ≤10% of $\mathbf{1}_C$, e.g., ≤100° C., such as ≤50° C. Using these $t_P$ values and the specified OFA typically limits temperature variations to ≤75° C. within any segment of thermal mass 1 that has a length ≤10% of is, e.g., ≤50° C., such as ≤25° C.

It has also been observed that utilizing a first thermal mass having an OFA in the specified range results in a decrease in $T_p$ and/or $T_{av}$ that is ≤100° C. during the course of the pyrolysis for commercially practical values of $t_P$, e.g., ≥1 second, and for a wide range of feeds and pyrolysis conditions. The pyrolysis conditions in the pyrolysis zone during $t_P$ generally include $T_p \leq 1400°$ C., $T_{av} \leq 1200°$ C., and an average total pressure ≥0 psig. Total gas residence time in the pyrolysis zone is generally ≤0.4 seconds to decrease the conversion to coke of desired products such as light olefin. Typically, the pyrolysis conditions include $T_p \leq 1200°$ C., e.g., ≤1100° C., such as ≤1000° C. or in the range of from 1000° C. to 1400° C.; $T_{av} \leq 1100°$ C., e.g., ≤1000° C., such as ≤900° C., or in the range of from 900° C. to 1100° C., or 925° C. to 1075° C.; and a feed hydrocarbon partial pressure ≥7 psia (48 kPa), or ≥10 psia (69 kPa), or ≥20 psia (138 kPa), or ≥30 psia (207 kPa). The average total pressure is typically ≥5 psig (34 kPag), or ≥15 psig (103 kPag), or ≥40 psig (276 kPag), or ≥80 psig (552 kPag), or ≥120 psig (827 kPag). Particularly when the pyrolysis feed includes diluent, the average total pressure can be ≥150 psig (1034 kPag), or ≥300 psig (2068 kPag), or ≥500 psig (3447 kPag). Total gas residence time in the pyrolysis zone is typically ≤0.2 second; preferably ≤0.15 second or ≤0.1 second; or in the range of 0.001 second to 0.4 second, or in the range of 0.01 second to 0.4 second, or in the range of 0.01 second to 0.2 second. For example, the pyrolysis feed can be passed through thermal mass 1 at a total gas residence time at a bulk gas temperature ≥800° C. that is ≤0.100 second, such as ≤0.060 second, such as ≤0.040 second, or in the range of 0.001 second to 0.100 second, or in the range of 0.002 second to 0.060 second, or in the range of 0.002 second to 0.040 second. When utilizing a first thermal mass having an OFA in the specified range, these conditions have been observed to decrease $T_p$ and/or $T_{av}$ by ≤100° C., e.g., ≤75° C., such as ≤50° C., or ≥25° C., or ≤10° C., or ≤5° C., for a $t_P \geq 1$ second, e.g., ≥2 seconds, such as ≥5 seconds, or ≥10 seconds, or ≥20 seconds, or ≥30 seconds, or even ≥1 minute or more.

Smaller values of OFA, which lead to a smaller decrease in the temperatures $T_p$ and $T_{av}$ during $t_P$, are typically desired at relatively large values of $T_p$, e.g., ≥1000° C., such as ≥1200° C. or ≥1300° C. Utilizing smaller variations in $T_p$ and $T_{av}$ during $t_P$ at relatively high pyrolysis temperatures has been found to moderate variations in the yield of less desirable pyrolysis products such as acetylene and coke as would otherwise occur during a commercially-reasonable $t_P$ (e.g., ≥2 seconds). This in turn leads to a simplification of olefin purification and recovery facilities. For example, when $T_{av}$ exceeds 900° C., it is beneficial for the thermal mass to have an OFA of ≤45%. When $T_{av}$ exceeds 1000° C., it is beneficial for the thermal mass to have an OFA of ≤35%, and when $T_{av}$ exceeds 1100° C., it is beneficial for the thermal mass to have an OFA of ≤25%. Stated another way, when $T_p$ exceeds 1000° C., it is beneficial for $\Delta T_p$ and/or $\Delta T_{av}$ to be ≤50° C., when $T_p$ exceeds 1100° C., it is beneficial for $\Delta T_P$ and/or $\Delta T_{av}$ to be ≤40° C., and when $T_p$ exceeds 1200° C., it is beneficial for $\Delta T_p$ and/or $\Delta T_{av}$ to be ≥20° C.

Figure 2:
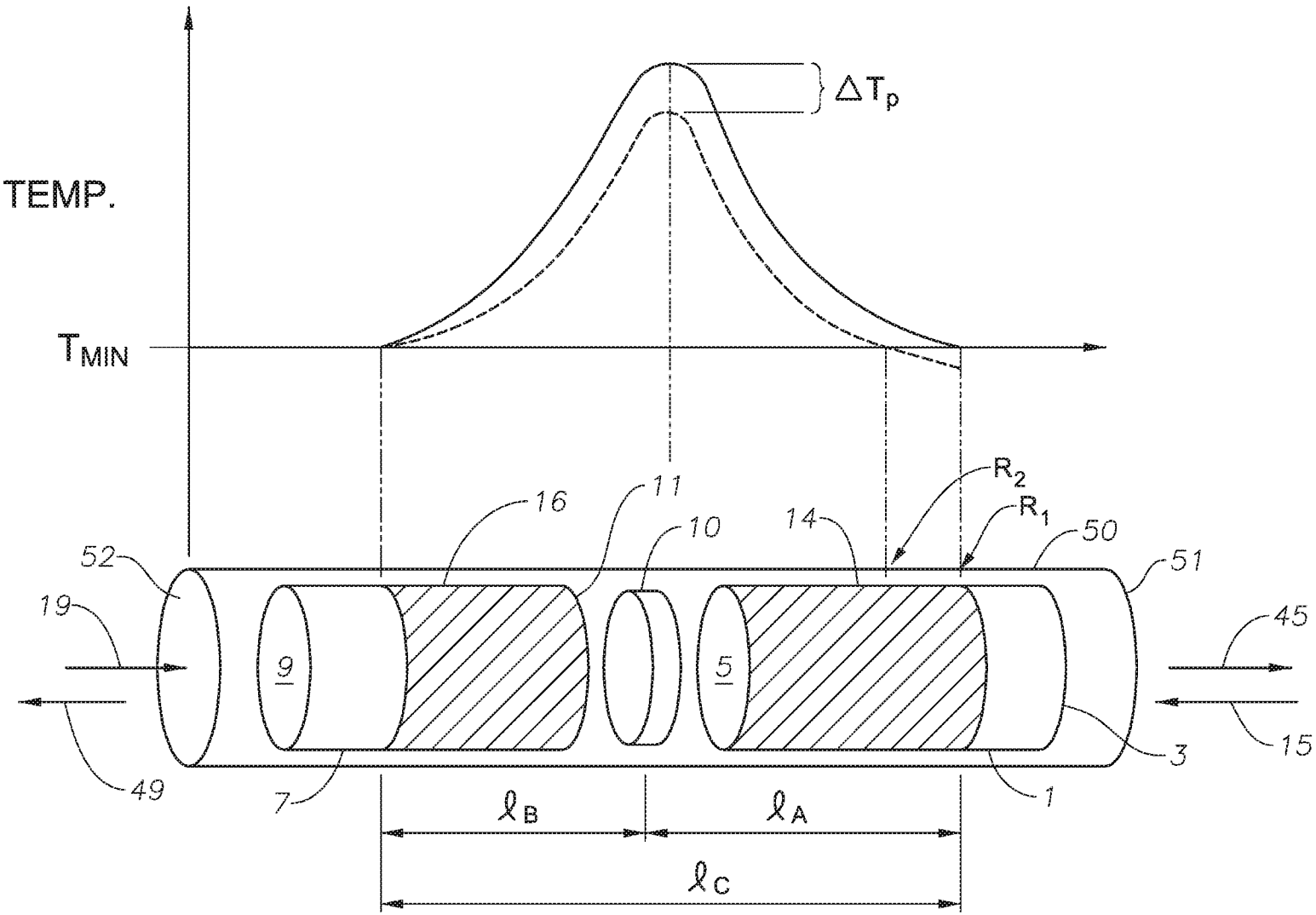
FIGS. 2-5 schematically show forms of a reverse flow reactor and representative bulk gas temperature profiles at the start (solid lines) and end (dashed lines) of pyrolysis mode.

FIG. 2 schematically shows a representative regenerative reverse-flow reactor, similar to that shown in FIG. 1, and a representative gas temperature profile. The solid line represents the bulk gas temperature profile at the start of pyrolysis mode, and the dashed line represents the bulk gas temperature profile at the end of $t_P$. At the start of pyrolysis mode, the flow of combustion mixture 19 is curtailed and a flow of pyrolysis feed 15 is established. The reactor's pyrolysis zone encompasses the combustion zone (e.g., the region between aperature 11 and aperture 5), the shaded region 16 of thermal mass 7, and the shaded region 14 of thermal mass 1. In certain aspects, the peak gas temperature $T_p$ during the pyrolysis is displaced away from the reactor's center. For example, the length of the pyrolysis zone's downstream segment $\mathbf{1}_A$ is less than that of the upstream segment $\mathbf{1}_B$, e.g., at least 10% less, such as at least 25% less, or at least 50% less. The total length of the pyrolysis zone $\mathbf{1}_C$ is the sum of $\mathbf{1}_A$ and $\mathbf{1}_B$. Typically. $\mathbf{1}_C$ is in the range of from 10% to 50% of the total length of reactor 50. e.g., in the range of 20% to 40%. For example, $\mathbf{1}_C$ can be in the range of from 20% to 40% of $L_1+L_2+L_3+L_4$. The locations of the terminal ends of $\mathbf{1}_A$ and $\mathbf{1}_B$ are determined by the minimum temperature $T_{MIN}$ needed for appreciable (≥10 wt. %) conversion of the selected pyrolysis feed under the specified pyrolysis conditions, e.g., in the range of 500° C. to 950° C.

Figure 3:
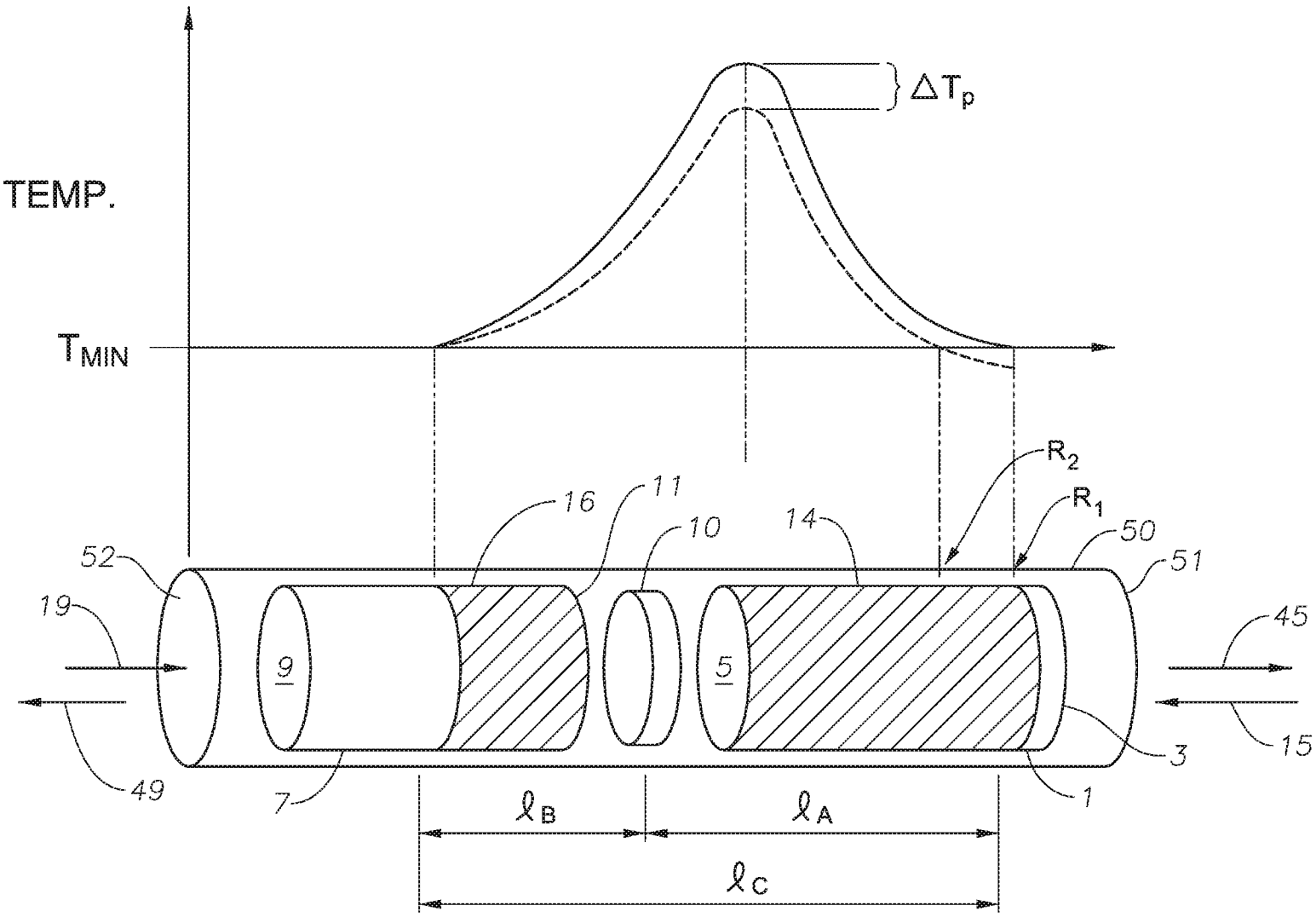

FIG. 2 shows aspects having a slight displacement of $T_p$ away from the reactor center. FIG. 3 shows an even greater displacement, with $T_p$ being located within shaded region 14 of thermal mass 1. In the aspects illustrated in FIG. 4, mixer-distributor 10 is located within the combustion zone. In such aspects, the bulk gas temperature profile at the start of pyrolysis mode (profile $PR_3$) exhibits at least two local maxima, as does profile $PR_4$ which represents the bulk gas temperature profile at the end $t_P$. While not wishing to be bound, it is believed that the bi-modal bulk gas temperature profile results from heat radiated from the mixer distributor during heating mode toward thermal masses 1 and 7. Since the downstream end of the mixer-distributer achieves a greater temperature than its upstream end during heating mode, and since radiative heating is a relatively short-range phenomena (the inverse-square law applies), thermal mass 1 is heated more than thermal mass 7. The resultant bulk gas temperature profile $PR_3$ at the start of pyrolysis mode is therefore believed to be a substantially linear combination of bulk gas temperature profile $PR_1$, which is related to the heating of thermal mass 7, and bulk gas temperature profile $PR_2$, which is related to the heating of thermal mass 1. As in the aspects illustrated by FIG. 3, greater fuel-oxidant flow rates during heating mode lead to additional heating of thermal mass 1, e.g., by convective heat transfer from the combustion product, which displaces the peak temperature of profile $PR_2$ toward (or even into) shaded region 14, as shown in FIG. 5. In FIGS. 1-5, components and streams performing similar functions have the same index number. The maximum gas temperature of profile $PR_1$ is typically 20% to 70% of the maximum gas temperature of profile $PR_2$, such as 30% to 70%.

Figure 4:
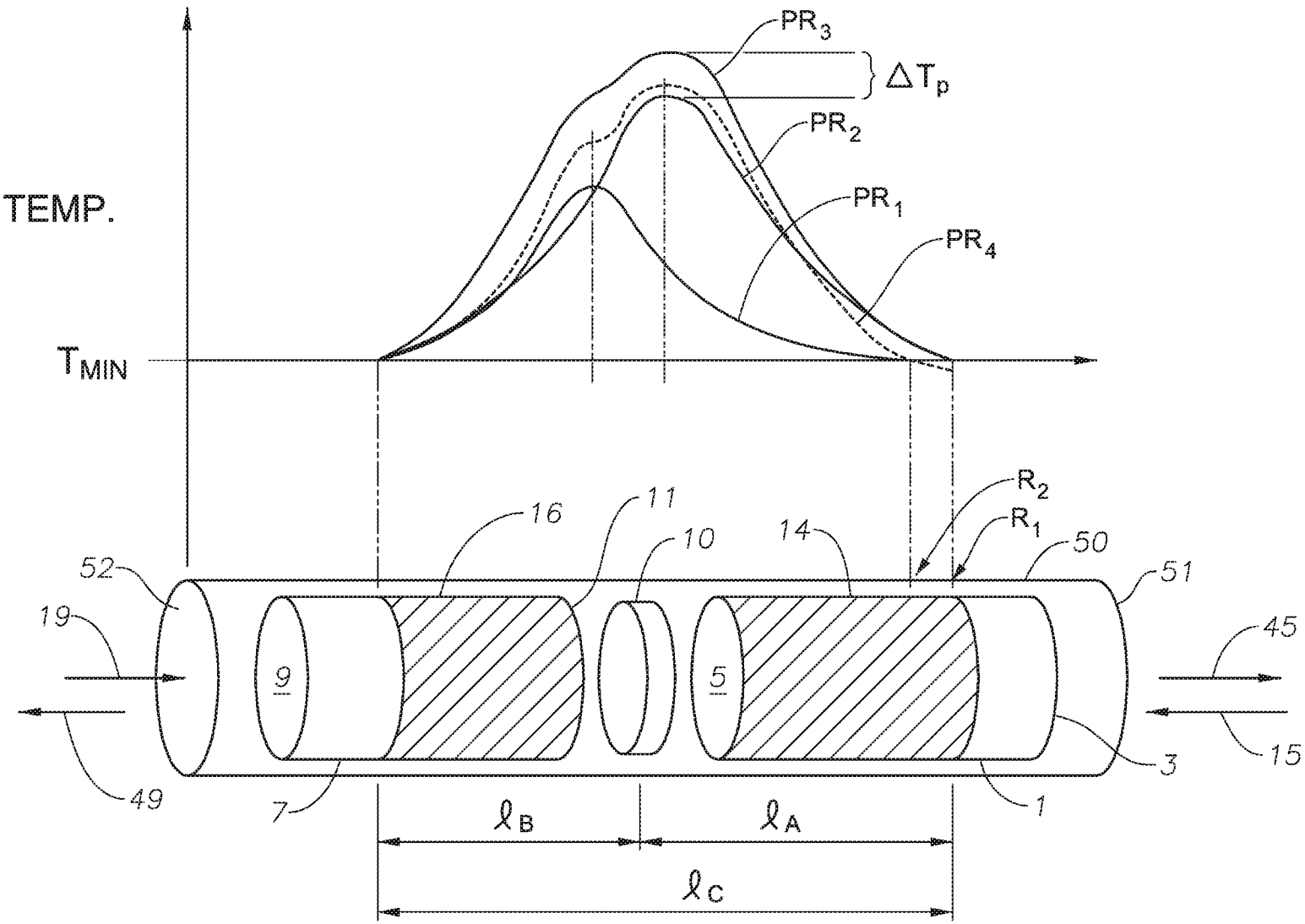
Figure 5:
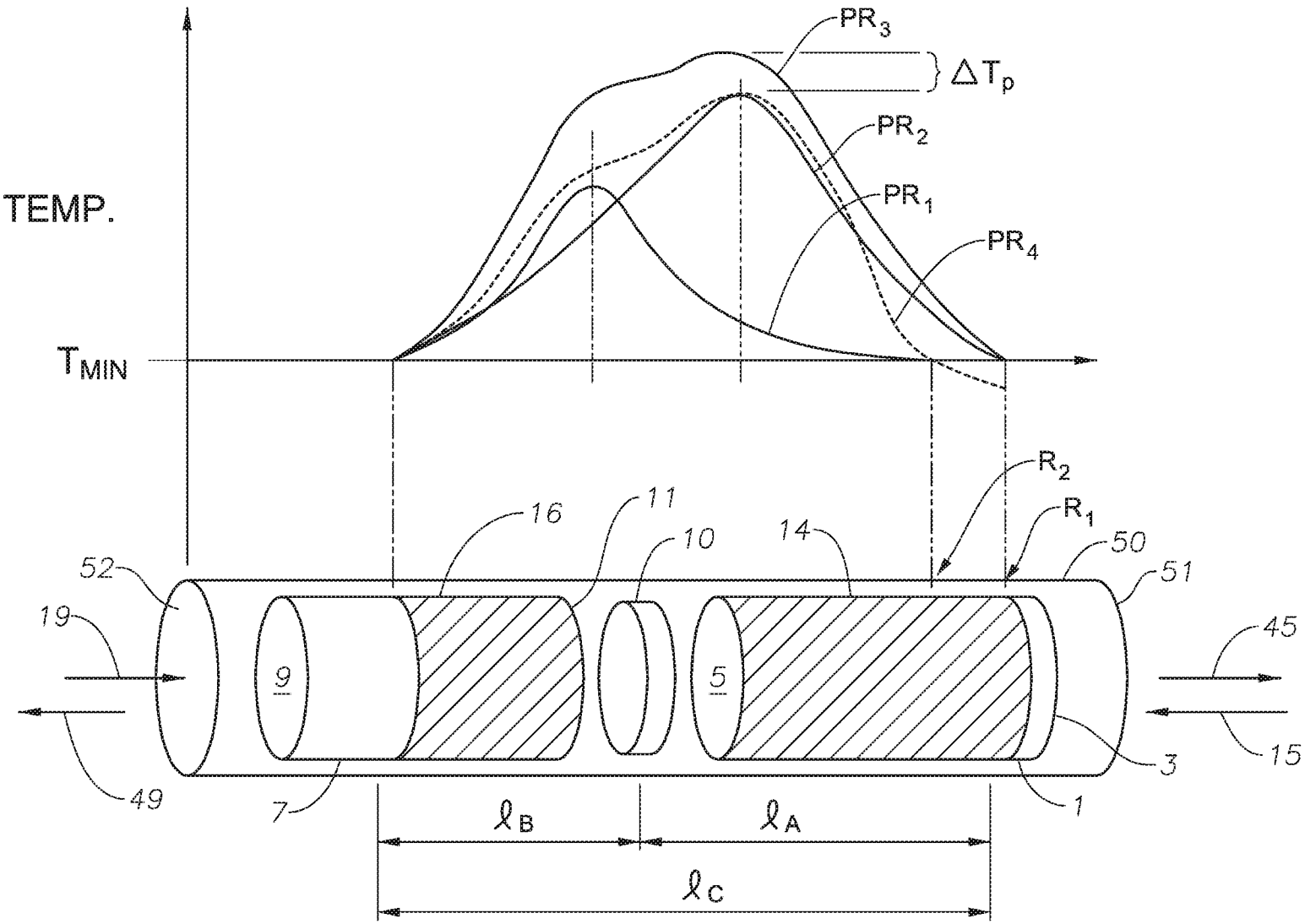

In aspects illustrated in FIGS. 2 and 4, the pyrolysis conditions include a bulk gas temperature profile which at the start of the pyrolysis increases e.g., (substantially monotonically) from a first temperature ($T_1$) proximate to the first aperture 3 of thermal mass 1 to a second temperature ($T_2$) proximate to the second aperture 5. The peak gas temperature $T_p$, located at a position that is at or downstream of face 5, is greater than $T_2$. $T_p-T_2$ at the start of pyrolysis is typically in the range of from 10° C. to 400° C., or 25° C. to 300° C., or 50° C. to 200° C. $T_p$ decreases during the pyrolysis by an amount ($\Delta T_p$) that is ≤100° C. Typically, the location of $T_p$ within the pyrolysis zone remains substantially constant during the pyrolysis. Substantially constant in this context means that the location of $T_p$ changes during pyrolysis mode from its initial position by ≤+/−20% of $1_c$, e.g., ≤+/−15%, such as ≤+/−10%, or typically ≤+/−5%. $T_1$ is less than $T_2$, with $T_2$ at the start of pyrolysis typically being ≤1400° C., e.g., ≤1300° C., such as ≤1200° C., or ≤1100° C., or ≤1000° C. $T_2-T_1$ at the start of pyrolysis is typically in the range of from 50° C. to 500° C., such as from 100° C. to 400° C., or 100° C. to 300° C. In particular aspects utilizing a feed comprising ethane and/or propane, the pyrolysis conditions at the start of pyrolysis include $T_1$≤900° C., e.g., ≤750° C., such as ≤500° C.; $T_2$ in the range of from 975° C. to 1100° C., $T_p$≥1150° C., and $T_{MIN}-T_1$ in the range of from 10° C. to 400° C., or 25° C. to 300° C., or 50° C. to 200° C. At the start of the pyrolysis, the conversion of the feed's $C_{2+}$ hydrocarbon exhibits a profile (not shown in FIG. 2) which increases from a first conversion ($X_1$) at a reference location $R_1$ positioned between the first and second apertures to a second conversion ($X_2$) proximate to the second aperture, wherein $X_1$ is in the range of from 25% to 85%, and $X_2$ is in the range of from 65% to 98%. Reference position $R_1$ is typically proximate to the end of the pyrolysis zone, as shown. The peak gas temperature decreases during $t_P$, but the bulk gas temperature profile typically maintains substantially the same shape as shown. Although the bulk gas temperature profile at the start of $t_P$ is substantially congruent with that at the end of $t_P$, the location in the pyrolysis zone at which conversion $X_1$ is achieved translates during $t_P$ from $R_1$ toward aperture 5 to reference position $R_2$ at the end of $t_P$ ($t=t_2$). At $t_2$ the bulk gas temperature profile increases substantially monotonically from a first temperature ($T_3$) proximate to the first aperture 3 of thermal mass 1 to a second temperature ($T_4$) proximate to the second aperture 5. $T_3$ is ≤$T_1$ and $T_4$ is in the range of from $T_2$ to ($T_2$−100° C.). e.g., $T_2$ to ($T_2$−75° C.), such as $T_2$ to ($T_2$−50° C.). In particular aspects where the feed comprises ethane and/or propane, the process can include one or more of (i) $X_1$ in the range of from 25% to 60%. (ii) $T_2$ in the range of from 1025° C. to 1075° C., (iii) $X_2$ in the range of from 85% to 98%, (iv) the bulk gas temperature profile includes a bulk gas temperature at the reference location in the range of from 925° C. to 975° C., and (v) the reference location $R_1$ is positioned within 0.2*$L_1$ and 0.4*$L_1$ of the second aperture. Particular conditions at the start of the pyrolysis can include (i) an acetylene selectivity in a range of from 0% to 1% at the reference location, which increases, e.g., monotonically, to a range of 5% to 10% at the second aperture, (ii) an ethylene selectivity in a range of from 85% to 95% at the reference location, which decreases, e.g., monotonically, to a range of 70% to 85% at the second aperture, (iii) a propylene selectivity in a range of from 0.7% to 0.9% at the reference location, which varies monotonically or non-monotonically to a range of 0.4% to 0.6% at the second aperture, and (iv) a butadiene selectivity in a range of from 0.5% to 1.5% at the reference location, which increases, e.g., monotonically, to a range of 4% to 5% at the second aperture.

In other aspects, shown schematically in FIGS. 3 and 5, the pyrolysis zone at time $t_1$ (the start of $t_P$) has a peak gas temperature $T_p$ at a position located between apertures 3 and 5. $T_p$ is >$T_2$, and $T_2$ is >$T_1$. $T_p$ is typically ≤1400° C., e.g., in the range of from 1000° C. to 1400° C., such as from 1000° C. to 1300° C., or from 1025° C. to 1175° C. $T_p-T_2$ is typically in the range of from 10° C. to 400° C., or 25° C. to 300° C., or 50° C. to 200° C. $T_2-T_1$ is typically in the range of from 50° C. to 500° C., such as from 100° C. to 400° C. $T_{MIN}$ is located between apertures 3 and 5. In particular aspects utilizing a feed comprising ethane and/or propane, $T_1$ can be ≤900° C., e.g., ≤750° C., such as ≤500° C.; with $T_2$ being in the range of from 975° C. to 1100° C., $T_p$ being ≥1150° C., and $T_{MIN}-T_1$ being in the range of from 10° C. to 400° C., or 25° C. to 300° C., or 50° C. to 200° C. In aspects where the feed comprises ethane and/or propane, $T_1$ is typically ≤750° C. and $T_2$ is in the range of from 900° C. to 1100° C. As in the aspects illustrated in FIGS. 2 and 4, the aspects illustrated in FIGS. 3 and 5 exhibit a favorable conversion profile for the feed's saturated $C_{2+}$ hydrocarbon. At $t_1$, the conversion profile continuously varies from a minimum conversion $X_{min}$ at a reference location between the first and second apertures to a second conversion ($X_2$) at the second aperture. Proximate to the location of $T_p$ (which location remains substantially the same during $t_P$), the conversion profile exhibits a peak ($X_p$), wherein $X_p$ is >$X_2$. At $t_1$, $X_2$ is in a range of from 55% to 95% and $X_p$ is ≤98%. During $t_P$, the conversion profile (not shown) exhibits a continuously decreasing conversion at the second aperture and a continuously decreasing $X_p$. $T_p$ decreases during $t_P$ by an amount ($\Delta T_p$) that is ≤100° C. In particular aspects where the feed comprises ethane and/or propane, at the time $t_1$ (i) $T_2$ is in the range of from 925° C. to 1075° C. and (ii) $X_2$ is in the range of from 85% to 98%. Typical pyrolysis conditions include one or more of (A) an acetylene selectivity in a range of from 5% to 10% at the second aperture at $t_1$, which decreases into a range of about 0% to 1% at $t_2$, (B) an ethylene selectivity in a range of from 75% to 80% at the second aperture at $t_1$, which increases into a range of about 90% to 95% at $t_2$, (C) a propylene selectivity in a range of from 0.7% to 0.9% at the second aperture at $t_1$, which varies by no more than about +/−20% during $t_P$, and (D) a butadiene selectivity in a range of from 4% to 5% at the second aperture at $t_1$, which decreases into a range of about 0.1% to 1.5% at $t_2$.

By modulating bulk gas temperature over the length of the pyrolysis zone during pyrolysis mode, the pyrolysis product conducted away from the reactor comprises a range of desired hydrocarbon products, including a desirable range of $C_2$-$C_5$ olefin. Typically, one or more of the desired hydrocarbon compounds is separated from the pyrolysis product, e.g., for storage and/or further processing. For example, one or more of ethylene, propylene, butadiene butenes, etc. can be separated from the pyrolysis product, e.g., for recovery and use in producing products such as fuels and fuel additives, oxygenates, polymer, etc. Molecular hydrogen and methane can be separated and recovered from the pyrolysis product, e.g., as a tail gas. Light paraffinic hydrocarbon can be separated recovered, e.g., for use as a fuel, such as a fuel for heating mode. Aromatic hydrocarbon, such as one or more of benzene, toluene, and xylenes, can be separated and recovered, e.g., for producing chemical and petrochemical products including fuel, solvents, polymer, etc. Conventional separations and recovery methods can be used. e.g., those described in U.S. Patent Application Publication No. 2016-176781, but the invention is not limited thereto. Since $T_p$, $T_{av}$, or typically both decrease by ≤100° C. during the course of the pyrolysis, e.g., ≤75° C., such as ≤50° C. or ≤25° C., or ≤10° C., or ≥5° C., yields of these desired products typically do not vary appreciably as a function of time during the course of the pyrolysis, leading to a considerable simplification of product recovery systems over conventional processes.

Certain representative pyrolysis products will now be described in more detail. The invention is not limited to these products, and this description is not meant to foreclose the production of other pyrolysis products within the broader scope of the invention.

Representative Pyrolysis Products

In certain aspects, the pyrolysis product conducted away from the reactor is primarily gaseous and comprises molecular hydrogen; methane; ethane; ethylene; propane; propylene; butanes; butenes; butadiene; $C_5$ hydrocarbon, including normal, iso, and cyclo $C_5$ olefin and paraffin, and $C_{6+}$ hydrocarbon, including aromatics and normal, iso, and cyclo $C_{6+}$ olefin and paraffin. For example, when utilizing one representative pyrolysis feed comprising light paraffinic hydrocarbon and representative heating mode and pyrolysis mode conditions, the pyrolysis product can comprise 2 wt. % to 10 wt. % methane, 50 wt. % to 95 wt. % ethylene, 0.2 wt. % to 1 wt. % propylene, 0.1 wt. % to 5 wt. % butadiene, and up to about 3 wt. % benzene, based on the weight of the pyrolysis product. As may be appreciated, these very desirable compositional ranges for the identified hydrocarbon compounds are achieved not only at the start of pyrolysis mode, but during the duration of $t_P$. This stands in sharp contrast to conventional processes operating at a gas temperature ≤1200° C., such as steam cracking, since these operate with little temperature variation in the pyrolysis zone, and produce a pyrolysis product having very narrow compositional ranges for the desired hydrocarbon compounds.

Example

In this prophetic example, a pyrolysis feed consisting essentially of ethane is exposed to the specified pyrolysis conditions in a representative reverse-flow reactor configured to be similar to the one illustrated in FIG. 2. Thermal mass 1 is an alumina honeycomb having an OFA of 0.55 and a Cp of 0.13 kj $kg^{-1\circ}$ $K^{-1}$. The alumina has a mass density of about 3900 kg/m. $T_{av}$ is about 990° C. at the start of pyrolysis mode, and is achieved at about midway along the reactor's length (proximate to the midpoint of $\mathbf{1}_C$). Gas residence time during pyrolysis mode is 0.2 seconds. Average total pressure doing the pyrolysis is 2.4 bar (absolute). The pyrolysis is carried out for a time $t_P$ of 20 seconds.

Figure 6:
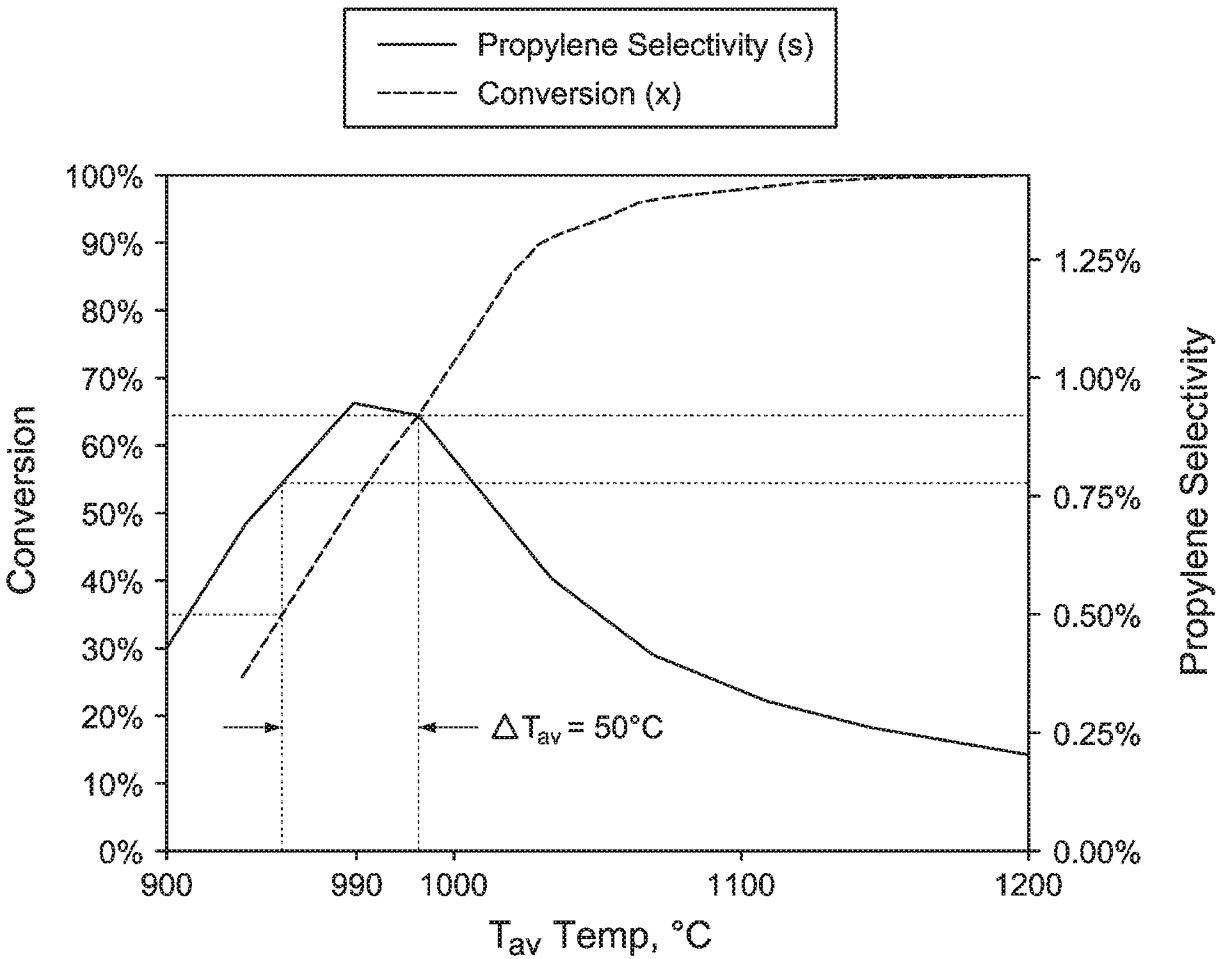
FIG. 6 shows the variation of conversion (dashed line) and propylene selectivity (solid line) as a function of $T_{av}$ under the conditions specified in the Example.
Figure 7:
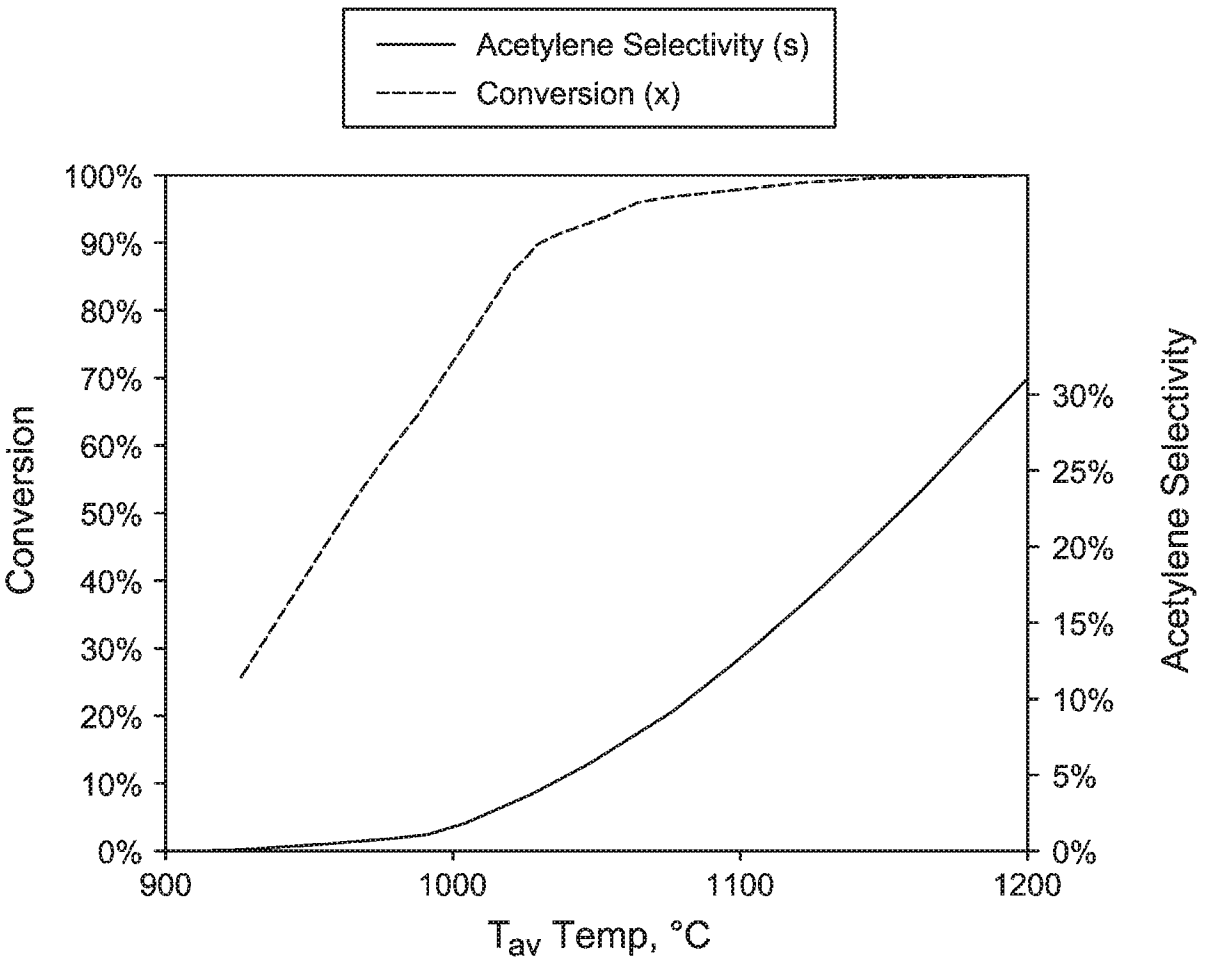
FIG. 7 shows the variation of conversion (dashed line) and acetylene selectivity (solid line) as a function of $T_{av}$ under the conditions specified in the Example.

The location of $T_p$ within the reactor is substantially constant during $t_P$, and $T_{av}$ at the end of pyrolysis mode is 940° C. Propylene yield (selectivity times conversion) does not vary appreciably over the indicated range of $\Delta T_{av}$, decreasing during $t_P$ from about 0.6 wt. % to about 0.3 wt. %. Since acetylene selectivity (FIG. 7) decreases slightly during $t_P$ (as does conversion), there is also a slight decrease in acetylene yield. Ethylene selectivity (not shown) increase slightly during $t_P$, resulting in little change in ethylene yield during $t_P$. Ethylene selectivity (not shown) increases during $t_P$, but this effect is partially offset by a commensurate decrease in conversion, resulting in an ethylene yield that does not vary appreciably during $t_P$. Accordingly, utilizing a first thermal mass having an OFA≤55% results in a $\Delta T_{av}$ of ≥100° C., leading to ethylene and propylene yields which do not vary appreciably during a $t_P$ that is of sufficient duration to be commercially achievable using conventional valving. Moreover, since there is little variation in acetylene yield during $t_P$, the separation of propylene from unsaturated $C_2$ compounds can be carried out efficiently without the need to include additional separation capacity. As can be seen in FIGS. 6 and 7, a lesser OFA is beneficial when the pyrolysis is carried out at a greater initial $T_{av}$, e.g., ≥1000° C., such as ≥1100° C., in order to provide a smaller ΔTa, which in turn lessens the variation in acetylene yield during $t_P$.

All patents, test procedures, and other documents cited herein, including priority documents, are fully incorporated by reference to the extent such disclosure is not inconsistent. It is not intended that the scope of the claims appended hereto be limited to the descriptions set forth herein but rather that the claims be construed as encompassing all patentable features which reside herein, including all features which would be treated as equivalents thereof by those skilled in the relevant art. When lower and upper limits are specified, ranges from any lower limit to any upper limit are expressly within the scope of the invention. The term "comprising" is synonymous with the term "including". When a composition, an element or a group of components is preceded with the transitional phrase "comprising", the same composition or group of components is within transitional phrases "consisting essentially of," "consisting of," "selected from the group of consisting of," or "is" preceding the recitation of the composition, component, or components, and vice versa.

The invention claimed is:

1. A hydrocarbon pyrolysis process, the process comprising:

(a) providing a feed comprising ≥1 wt. % of $C_{2+}$ hydrocarbon;

(b) providing an elongated flow-through reactor having (i) an internal volume which includes first and second regions, opposed first and second openings in fluidic communication with the internal volume, wherein the first and second openings are separated by a reactor length ($L_R$), and (ii) a first channeled thermal mass located in the first region, the first channeled thermal mass having an open frontal area ≤55% and comprising a refractory, wherein the first channeled thermal mass includes:

(A) a first aperture, the first aperture being proximate to the first opening and in fluidic communication with the first opening, (B) at least one internal channel in fluidic communication with the first aperture, and (C) a second aperture, the second aperture being in fluidic communication with the first aperture via a flowpath $L_1$ through the channel, $L_1$ being $\geq 0.1*L_R$;

(c) heating the first channeled thermal mass;

(d) establishing a flow of the feed into the channel toward the second aperture at a flow rate ≥0.01 kg/s by introducing the feed through the first opening and through the first aperture;

(e) pyrolysing the feed flow's $C_{2+}$ hydrocarbon in the channel under pyrolysis conditions during a pyrolysis time interval $t_P$ of at least one second which begins at a first time $t_1$ and ends at a second time $t_2$ which cools the first channeled thermal mass and produces a flow of a pyrolysis product comprising molecular hydrogen and $C_{2+}$ olefin, wherein the pyrolysis conditions include:

(i) a conversion ≥50 wt. %, (ii) a first gas temperature profile at $t_1$ which increases substantially monotonically from a first temperature ($T_1$) proximate to the first aperture to a second temperature ($T_2$) proximate to the second aperture, with $T_2$ being in the range of from 800° C. to 1400° C., and (iii) a second gas temperature profile at $t_2$ which exhibits a temperature $T_3$ proximate to the first aperture and a temperature $T_4$ proximate to the second aperture, wherein $T_3$ is $\leq T_1$ and $T_4$ is in the range of from $T_2$ to ($T_2$−100° C.); and (f) during $t_P$, conducting the flow of the pyrolysis product into the second region of the internal volume via the second aperture, and away from the reactor via the second opening.

2. A hydrocarbon pyrolysis process, the process comprising:

(a) providing a feed comprising ≥1 wt. % of $C_{2+}$ hydrocarbon;

(b) providing an elongated flow-through reactor having (i) an internal volume which includes first and second regions, opposed first and second openings in fluidic communication with the internal volume, wherein the first and second openings are separated by a reactor length ($L_R$), and (ii) a first channeled thermal mass located in the first region, the first channeled thermal mass having an open frontal area ≤55% and comprising a refractory, wherein the first channeled thermal mass includes:

(A) a first aperture, the first aperture being proximate to the first opening and in fluidic communication with the first opening, (B) at least one internal channel in fluidic communication with the first aperture, and (C) a second aperture, the second aperture being in fluidic communication with the first aperture via a flowpath $L_1$ through the channel, $L_1$ being $\geq 0.1*L_R$;

(c) heating the first channeled thermal mass;

(d) establishing a flow of the feed into the channel toward the second aperture at a flow rate ≥0.01 kg/s toward the second aperture by introducing the feed through the first opening and through the first aperture;

(e) pyrolysing the feed flow's $C_{2+}$ hydrocarbon in the channel under pyrolysis conditions during a pyrolysis time interval $t_P$ of at least one second which begins at a first time $t_1$ and ends at a second time $t_2$ which cools the first thermal mass and produces a flow of a pyrolysis product comprising molecular hydrogen, and $C_{2+}$ olefin, the pyrolysis conditions including:

(i) a conversion ≥50 wt. %, (ii) a peak gas temperature $T_p$ located within the reactor, the peak gas temperature being positioned along $L_1$, (iii) a first bulk gas temperature profile at $t_1$ which varies continuously along $L_1$ from a first temperature ($T_1$) proximate to the first aperture to a second temperature ($T_2$) proximate to the second aperture, wherein $T_1<T_2$, $T_2<T_p$, and $T_2$ is in the range of from 800° C. to 1400° C., (iv) a second gas temperature profile at $t_2$ which exhibits a temperature $T_3$ proximate to the first aperture and $T_4$ proximate to the second aperture, wherein $T_3$ is $\leq T_1$ and $T_4$ is $<T_2$, and (v) during $t_P$, $T_p$ decreases by an amount that does not exceed 100° C. and the position of $T_p$ along $L_1$ remains substantially constant; and (f) during $t_P$, conducting the flow of the pyrolysis product into the second region of the internal volume via the second aperture, and away from the reactor via the second opening.

3. The process of claim 1, wherein (i) the reactor has a peak gas temperature $T_p$ within the internal volume, (ii) $T_p$ is located in the second region, $T_p$ is $>T_2$ at $t_1$, $T_p$ decreases during $t_P$, (iii) the location of $T_p$ remains substantially constant during $t_P$, (iv) the pyrolysis conditions further include a hydrocarbon partial pressure of ≥7 psia (48 kPa) and a total pressure of ≥5 psig (34 kPag), and (v) $t_P$ is ≥2 seconds.

4. The process of claim 1, wherein (i) the reactor is a reverse-flow thermal pyrolysis reactor, the reactor further comprising a second thermal mass located in the second region of the internal volume, the second thermal mass having at least one internal channel having at least one in fluidic communication with the internal channel of the first thermal mass, and (ii) the process further comprises (f) conducting the pyrolysis product through the internal channel of the second thermal mass before the pyrolysis product is conducted away from the reverse-flow reactor, and (g) cooling the pyrolysis product by transferring heat from the pyrolysis product to the second thermal mass.

5. The process of claim 1, wherein (i) the $C_{2+}$ olefin includes one or more of ethylene, propylene, and butylene, (ii) the pyrolysis product further comprises coke and one or more of acetylene, benzene, methane, and at least a portion of any unconverted feed, and (iii) at least a portion of the coke remains in the internal channel of the first thermal mass as a deposit.

6. The process of claim 1, wherein the feed comprises one or more of ethane, propane, butanes, saturated and unsaturated $C_6$ hydrocarbon, including those derived from one or more of Fischer-Tropsch synthesis products, shale gas, biogas, associated gas, natural gas and mixtures or components thereof, steam cracked gas oil and residues, gas oils, heating oil, jet fuel, diesel, kerosene, gasoline, naphtha (including coker naphtha, steam cracked naphtha, and catalytically cracked naphtha), hydrocrackate, reformate, raffinate reformate, Fischer-Tropsch liquids, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, synthetic crudes, shale oils, coal liquefaction products, coal tars, tars, atmospheric resid, heavy residuum, $C_4$-residue admixture, naphtha-residue admixture, cracked feed, coker distillate streams, and hydrocarbon streams derived from plant or animal matter.

7. The process of claim 1, wherein the feed comprises ≥90 wt. % of (i) ethane and/or (ii) propane, and the conversion is ≥60 wt. %.

8. The process of claim 1, wherein (i) $T_2$ continuously decreases to $T_4$ during the pyrolysis, and (ii) the first and second temperature profiles are substantially congruent.

9. The process of claim 1, wherein (i) $t_P$ is ≥2 seconds, (ii) the pyrolysis conditions include a gas residence time in the channel of ≤0.5 seconds, (iii) the feed flow rate is substantially constant during $t_P$ and ≥0.1 kg/s, (iv) the open frontal area is in the range of from 10% to 50%; (v) the first thermal mass has a thermal conductivity in the range of from 0.5 W/m° K to 50 W/m° K, a coefficient of thermal expansion in the range of from $1\times10^{-7}$/° K to $2\times10^{-5}$/° K, an average wetted surface area per unit volume in the range of from 1 $cm^{-1}$ to 100 $cm^{-1}$, an average wetted surface area per unit volume in the range of from 1 $cm^{-1}$ to 100 $cm^{-1}$; (vi) the internal channel of the first thermal mass includes a plurality of substantially parallel passages and has a passage density in the range of from 77000/$m^2$ to $1.3\times10^6$/$m^2$; (vii) the refractory has a specific heat capacity at 300° K≥0.04 [kj/(° K kg)] and a mass density ≥3000 kg/$m^3$; and (vii) the refractory includes at least one oxide of one or more elements selected from Groups 2-14 of the Periodic Table.

10. The process of claim 9, wherein the first thermal mass is in the form of at least one monolithic honeycomb having a mass ≥1 kg; the refractory's oxide includes oxide of at least one of Al, Si, Mg, Ca, Fe, Mn, Ni, Co, Cr, Ti, Hf, V, Nb, Ta, Mo, W, Sc, La, Yt, Zr, and Ce; the refractory's specific heat capacity at 300° K is in the range of from 0.04 [kj/(° K kg)] to 1.2 [kj/(° K kg)]; the refractory's mass density is in the range of from 3000 kg/$m^3$ to 5000 kg/$m^3$; $T_1$ is ≤750° C.; $t_P$ is in the range of from 2 to 15 seconds; and the gas residence time in the channel is in the range of from 0.01 second to 0.4 second.

11. A hydrocarbon pyrolysis process, the process comprising:

(a) providing a feed comprising ≥1 wt. % of $C_{2+}$ hydrocarbon;

(b) providing an elongated flow-through reactor having a pyrolysis zone located within the reactor during a pyrolysis time $t_P$, the first and second openings being in fluidic communication with the pyrolysis zone, wherein the reactor includes an elongated channeled thermal mass of length $L_M$, $L_M$ being ≥0.1*$L_R$, and wherein the elongated channeled thermal mass comprises refractory, has an open frontal area ≤55%, and includes (i) a first aperture proximate to the first opening, (ii) at least one internal channel at least 25% of which is located in the pyrolysis zone at the start of $t_P$, the internal channel being in fluidic communication with the first aperture, and (iii) a second aperture that is in fluidic communication with the first aperture and is separated from the first aperture by a flow-path through the channel;

(c) heating the elongated channeled thermal mass;

(d) establishing a flow of the feed into the internal channel during $t_P$ via the first opening and the first aperture;

(e) pyrolysing the feed flow's $C_{2+}$ hydrocarbon in the pyrolysis zone under pyrolysis conditions during to cool the elongated channeled thermal mass and produce a flow of a pyrolysis product away from the pyrolysis zone, wherein $t_P$ is ≥1 second, the pyrolysis zone has an average temperature $T_{av}$ at the start of $t_P$ in the range of from 500° C. to 1200° C., the pyrolysis product comprises molecular hydrogen and $C_{2+}$ olefin, and the pyrolysis conditions include (i) a conversion ≥50 wt. %, a gas residence time in the pyrolysis zone ≤0.5 second, and a total pressure ≥0 psig, (ii) a peak gas temperature $T_p$ located within the pyrolysis zone, and (iii) during $t_P$, (A) $T_{av}$ decreases by no more than 100° C. and (B) the location of $T_p$ within the pyrolysis zone remains substantially constant; and (f) during $t_P$ conducting the flow of the pyrolysis product away from the reactor via the second opening.

12. The process of claim 11, wherein the conversion is ≥60 wt. %, the gas residence time in the pyrolysis zone is ≤0.4 second, $t_P$ is ≥2 seconds, and the total pressure ≥5 psig, and the pyrolysis conditions further include a hydrocarbon partial pressure of ≥7 psia (48 kPa).

13. The process of claim 11, wherein $T_{av}$ and $T_p$ each decrease by no more than 75° C. during $t_P$.

14. The process of claim 11, wherein (i) the $C_{2+}$ olefin includes one or more of ethylene, propylene, and butylene, (ii) the pyrolysis product further comprises coke and one or more of acetylene, benzene, methane, and at least a portion of any unconverted feed, and (iii) at least a portion of the coke remains in the internal channel as a deposit.

15. The process of claim 11, wherein the feed comprises one or more of ethane, propane, butanes, saturated and unsaturated $C_6$ hydrocarbon, including those derived from one or more of Fischer-Tropsch synthesis products, shale gas, biogas, associated gas, natural gas and mixtures or components thereof, steam cracked gas oil and residues, gas oils, heating oil, jet fuel, diesel, kerosene, gasoline, naphtha (including coker naphtha, steam cracked naphtha, and catalytically cracked naphtha), hydrocrackate, reformate, raffinate reformate, Fischer-Tropsch liquids, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, synthetic crudes, shale oils, coal liquefaction products, coal tars, tars, atmospheric resid, heavy residuum, $C_4$-residue admixture, naphtha-residue admixture, cracked feed, coker distillate streams, and hydrocarbon streams derived from plant or animal matter.

16. The process of claim 11, wherein ≥90 wt. % of the feed is a mixture of ethane and propane.

17. The process of claim 11, wherein at the start of $t_P$, $T_{av}$ is in the range of from 925° C. to 1075° C.

18. The process of claim 11, wherein:

(i) the internal channel includes a plurality of substantially parallel passages having a having a passage density in the range of from 77000/$m^2$ to $1.3\times10^6$/$m^2$, (ii) the open frontal area is in the range of from 10% to 45%, (iii) the refractory has a specific heat capacity at 300° K in the range of from 0.04 kj/(° K kg) to 1.2 kj/(° K kg), (iv) the elongated channeled thermal mass has a thermal conductivity in the range of from 0.5 W/m° K 50 W/m° K, (v) the elongated channeled thermal mass has a coefficient of thermal expansion in the range of from $1\times10^{-7}$/° K and $2\times10^{-5}$/° K, (vi) the elongated channeled thermal mass has an average wetted surface area per unit volume in the range of from 1 $cm^{-1}$ to 100 $cm^{-1}$, (vii) the refractory has a mass density in the range of from 3000 $kg/m^3$ to 5000 $kg/m^3$, and (viii) the metal oxide includes one or more of yttria, zirconia, alumina, and silica.

19. The process of claim 11, wherein the gas residence time in the channel is in a range of from 0.01 to 0.4 second, and the elongated channeled thermal mass includes at least one monolithic honeycomb having a mass ≥1 kg.

20. The process of any claim 11, wherein the pyrolysis zone has a first bulk gas temperature profile at the start of $t_P$, a second bulk gas temperature profile at the end of $t_P$, and the first and second bulk gas temperature profiles are substantially congruent.

21. A hydrocarbon pyrolysis process, the process comprising:

(a) providing a feed comprising gaseous $C_{2+}$ hydrocarbon;

(b) providing an oxidant and a fuel;

(c) providing an heated reverse-flow reactor, the reactor including (i) an elongated tube of length $L_R$ having opposed first and second openings and an internal volume, the first and second openings being in fluidic communication with the internal volume, and (ii) an elongated thermal mass of length $L_M$ located within the internal volume, $L_M$ being $\geq 0.1*L_R$, wherein the thermal mass comprises refractory, and includes (A) a first aperture proximate to the first opening, (B) at least one internal channel within the thermal mass, the internal channel being in fluidic communication with the first aperture, (C) a second aperture that is in fluidic communication with the first aperture and separated from the first aperture by a flow-path through the channel, and (D) an open frontal area ≤55%;

(e) during a first time interval $t_P \geq 1$ second which begins at time $t_1$ and ends at time $t_2$, (i) establishing a forward flow of the feed into the internal channel during $t_P$ via the first opening and the first aperture, (ii) pyrolysing at least a portion of the feed flow's $C_{2+}$ hydrocarbon in the channel under pyrolysis conditions which cools the thermal mass and produces a flow of a pyrolysis product away from the reactor, wherein the pyrolysis occurs over at least 25% of $L_M$ at $t_1$, the pyrolysis product comprises molecular hydrogen and $C_{2+}$ olefin, and the pyrolysis conditions include (A) a conversion ≥50 wt. %, a gas residence time in the pyrolysis zone ≤0.5 second, and a total pressure ≥0 psig, (B) a gas temperature profile exhibiting a peak temperature located within $L_M$ and a $T_{av}$ in the range of from 500° C. to 1200° C., and (C) during $t_P$, $T_{av}$ decreases by no more than 100° C. and the position of $T_p$ within the pyrolysis zone remains substantially constant;

(D) conducting the forward flow of the pyrolysis product out of the second aperture, and away from the reactor via the second opening; and (E) decreasing or halting the feed flow at $t_2$; and (f) during a second time interval having a duration $t_H$ in the range of from 0.1 seconds to 100 seconds, (i) establishing a reverse flow of the fuel and a reverse flow of the oxidant toward the reactor (ii) combusting oxidant in the oxidant flow with fuel in the fuel flow in the internal volume under combustion conditions to produce a reverse flow of a combustion product toward the thermal mass, (iii) conducting at least a portion of the combustion product into the channel of the thermal mass at the second aperture toward the first aperture and transferring heat from the combustion to the reactor to at least partly reheat the reactor;

(iv) conducting the combustion product out of the first aperture, out of the first opening, and away from the reactor; and (v) decreasing the reverse flow of fuel and the reverse flow of oxidant.

22. The pyrolysis product of claim 1.

23. A reverse-flow reactor, comprising:

(a) a reactor vessel having an internal volume which includes opposed first and second heat-transfer zones, and a reaction zone located between the first and second heat-transfer zones, wherein:

(i) the reaction zone, the first heat transfer zone, and the second heat transfer zone are in fluidic communication (ii) the reaction zone and first heat transfer zone include a first thermal mass having an open frontal area ≤55%;

(iii) the reaction zone and second heat transfer zone include a second thermal mass, and (iv) the first thermal mass includes refractory comprising at least one metal oxide, the refractory having a specific heat capacity at 300° K≥0.04 kj/(° K kg) and a mass density ≥3000 $kg/m^3$;

(b) at least one feed conduit in fluidic communication with the first heat-transfer zone to convey a forward flow of a gaseous feed comprising $C_{2+}$ hydrocarbon through the first heat transfer zone and into the reaction zone, the reaction zone being adapted to:

(i) pyrolyse during time interval $t_P$ at least a portion of the feed and produce a pyrolysis product comprising coke, molecular hydrogen, and olefin, and (ii) establish a forward flow of the pyrolysis product out of the pyrolysis zone and through the second heat-transfer zone and deposit at least a portion of the coke in the reaction zone, wherein:

(A) the reaction zone has a gas temperature profile having an average temperature $T_{av}$ which at the start of $t_P$ is in the range of from 800° C. to 1100° C., and (B) $T_{av}$ decreases by no more than 100° C. during $t_P$;

(c) at least one pyrolysis product conduit in fluidic communication with the second heat-transfer zone to convey a forward flow of the pyrolysis product away from the heat-transfer zone and out of the reverse-flow reactor during $t_P$;

(d) at least one fuel conduit in fluidic communication with the combustion zone to convey a reverse flow of a fuel to the combustion zone;

(e) at least one oxidant conduit in fluidic communication with the combustion zone to convey a reverse flow of an oxidant to the combustion zone, wherein;

(i) the reaction zone is adapted to combust at least a portion of the fuel with a first portion of the oxidant and convey away from the reaction zone at least (A)

a reverse-flow of a first combustion product and (B) a reverse flow of un-combusted oxidant and (ii) the reaction zone is adapted to oxidize the coke deposits with the un-combusted oxidant flow to produce a second combustion product;

(f) at least one combustion product conduit in fluidic communication with the combustion zone to convey a reverse-flow of the first and second combustion products away from the reaction zone and out of reverse-flow reactor; and (g) at least one flow controller to (i) establish during time interval $t_P$ the forward flows of the gaseous feed and the pyrolysis product and (ii) establish during a second time interval the reverse flows of flow of the fuel, the oxidant, and the combustion product.

24. The reverse flow reactor of claim 23, wherein the open frontal area is ≤45%.

25. The reverse flow reactor of claim 23, wherein:

(i) the open frontal area is in the range of from 10% to 45%, (ii) the refractory has a specific heat capacity at 300° K in the range of from 0.04 kj/(° K kg) to 1.2 kj/(° K kg), (iii) the thermal mass has a thermal conductivity in the range of from 0.5 W/m° K 50 W/m° K, (iv) the thermal mass has a coefficient of thermal expansion in the range of from $1\times10^{-7}$/° K and $2\times10^{-5}$/° K, (v) the thermal mass has an average wetted surface area per unit volume in the range of from 1 $cm^{-1}$ to 100 $cm^{-1}$, (vi) the refractory has a mass density in the range of from 3000 $kg/m^3$ to 5000 $kg/m^3$, and (vii) the refractory comprises oxide of one or more of xttrium, zirconium, aluminum and silicon.

* * * * *